US010125750B2

(12) United States Patent
Pfaff et al.

(10) Patent No.: US 10,125,750 B2
(45) Date of Patent: Nov. 13, 2018

(54) RADIAL PISTON PUMP ASSEMBLIES AND USE THEREOF IN HYDRAULIC CIRCUITS

(71) Applicant: HUSCO International, Inc., Waukesha, WI (US)

(72) Inventors: Joe Pfaff, Wauwatosa, WI (US); Bradley Kramer, Oconomowoc, WI (US); Dwight Stephenson, Oconomowoc, WI (US); Eric Hamkins, Waukesha, WI (US)

(73) Assignee: HUSCO International, Inc., Waukesha, WI (US)

( * ) Notice: Subject to any disclaimer, the term of this patent is extended or adjusted under 35 U.S.C. 154(b) by 237 days.

(21) Appl. No.: 15/205,517

(22) Filed: Jul. 8, 2016

(65) Prior Publication Data

US 2017/0009753 A1 Jan. 12, 2017

Related U.S. Application Data

(60) Provisional application No. 62/191,000, filed on Jul. 10, 2015.

(51) Int. Cl.
*F04B 1/053* (2006.01)
*F04B 1/04* (2006.01)
(Continued)

(52) U.S. Cl.
CPC ..... *F04B 1/0538* (2013.01); *E02F 9/2232* (2013.01); *F04B 1/04* (2013.01);
(Continued)

(58) Field of Classification Search
CPC ..... F04B 1/06; F04B 1/063; F04B 1/0538; F04B 49/225
See application file for complete search history.

(56) References Cited

U.S. PATENT DOCUMENTS 3,398,698 A 8/1968 Eickmann
5,167,493 A * 12/1992 Kobari ..... F04B 1/0536 417/273
(Continued)

FOREIGN PATENT DOCUMENTS

WO 2008012587 A2 1/2008

OTHER PUBLICATIONS

International Preliminary Report on Patentability issued in corresponding international application PCT/US2016/041503 dated Jan. 16, 2018.
(Continued)

*Primary Examiner* — Thomas E Lazo
(74) *Attorney, Agent, or Firm* — Andrus Intellectual Property Law, LLP

(57) ABSTRACT

A system and method for machinery performing work with hydraulic actuators. Radial hydraulic pumps are aligned end-to-end along a common driveshaft axis to form a multi-pump assembly having a plurality of piston/cylinder units extending in a radial direction. Two or more piston/cylinder units are associated with one another to form multiple piston/cylinder groups. A plurality of control valves combines individual output flows from the two or more associated piston/cylinder units into respective common output flows for each respective piston/cylinder group. A plurality of flow control devices varies the common output flow from each respective piston/cylinder group by throttling inlet flow to the two or more associated piston/cylinder units in each respective piston/cylinder group. Each respective common output flow is directed from each respective piston/cylinder group to a hydraulic actuator on the heavy machinery to control its direction of movement.

27 Claims, 15 Drawing Sheets

(51) Int. Cl.

| | |
|---|---|
| ***F04B 49/22*** | (2006.01) |
| ***F04B 53/16*** | (2006.01) |
| ***F15B 11/08*** | (2006.01) |
| ***F15B 11/16*** | (2006.01) |
| ***E02F 9/22*** | (2006.01) |
| ***F04B 1/06*** | (2006.01) |
| ***F04B 49/00*** | (2006.01) |

(52) U.S. Cl.
CPC ..... *F04B 1/0531* (2013.01); *F04B 1/06* (2013.01); *F04B 1/063* (2013.01); *F04B 49/002* (2013.01); *F04B 49/225* (2013.01); *F04B 53/16* (2013.01); *F15B 11/08* (2013.01); *F15B 11/16* (2013.01); *F15B 2211/2053* (2013.01); *F15B 2211/255* (2013.01); *F15B 2211/40515* (2013.01)

(56) References Cited

U.S. PATENT DOCUMENTS

| | | | | |
|---|---|---|---|---|
| 5,701,873 | A | 12/1997 | Schneider | |
| 7,766,626 | B2 | 8/2010 | Pabst et al. | |
| 7,823,982 | B2 | 11/2010 | Reuter et al. | |
| 8,052,401 | B2 | 11/2011 | Kovach et al. | |
| 8,206,125 | B2 | 6/2012 | Kuttler et al. | |
| 8,348,627 | B2 * | 1/2013 | Rampen | F03C 1/0447 417/139 |
| 8,500,215 | B2 | 8/2013 | Gastauer et al. | |
| 8,926,298 | B2 * | 1/2015 | Rajput | F04B 1/0408 417/532 |
| 9,062,665 | B2 | 6/2015 | Schedgick et al. | |
| 2010/0037604 | A1 * | 2/2010 | Rampen | F15B 11/0445 60/445 |
| 2012/0111185 | A1 | 5/2012 | Stephenson et al. | |

OTHER PUBLICATIONS

International Search Report and Written Opinion for PCT/US2016/041503 issued by the European Patent Office, dated Oct. 6, 2016.

INCOVA Technologies, "What is INCOVA?", website last visited Jun. 15, 2016, available at http://www.incova.com/?page_id=24&lang=en.

Cat Pumps, Data Sheet 35 Frame Plunger Pumps, product literature, website last visited Jun. 15, 2016, available at http://www.catpumps.com/products/pdfs/3535_H.pdf.

* cited by examiner

RADIAL PISTON PUMP ASSEMBLIES AND USE THEREOF IN HYDRAULIC CIRCUITS

CROSS REFERENCE TO RELATED APPLICATION

The present application claims the benefit of U.S. Provisional Application Ser. No. 62/191,000, filed Jul. 10, 2015, which is hereby incorporated by reference herein.

FIELD

The present disclosure relates to radial piston pumps, radial piston pump/valve assemblies, and use of radial piston pump/valve assemblies in hydraulic circuits, for example to control multiple functions on a piece of heavy construction equipment.

BACKGROUND

U.S. Patent Application Publication No. 2012/0111185, which is hereby incorporated by reference herein, discloses a high efficiency diametrically compact, radial oriented piston hydraulic machine including a cylinder block with a plurality of cylinders coupled to a first port by a first valve and to a second port by a second valve. A drive shaft with an eccentric cam, is rotatably received in the cylinder block and a cam bearing extend around the eccentric cam. A separate piston is slideably received in each cylinder. A piston rod is coupled at one end to the piston and a curved shoe at the other end abuts the cam bearing. The curved shoe distributes force from the piston rod onto a relatively large area of the cam bearing and a retaining ring holds each shoe against the cam bearing. The cylinder block has opposing ends with a side surface there between through which every cylinder opens. A band engages the side surface closing the openings of the cylinders.

U.S. Pat. No. 8,926,298, which is hereby incorporated by reference herein, discloses a radial piston pump having a plurality of cylinders within which pistons reciprocally move. Each cylinder is connected to a first port by an inlet passage that has an inlet check valve, and is connected to a second port by an outlet passage that has an outlet check valve. A throttling plate extends across the inlet passages and has a separate aperture associated with each inlet passage. Rotation of the throttling plate varies the degree of alignment of each aperture with the associated inlet passage, thereby forming variable orifices for altering displacement of the pump. Uniquely shaped apertures specifically affect the rate at which the variable orifices close with throttle member movement, so that the closure rate decreases with increased closure of the variable orifices.

U.S. Pat. No. 9,062,665, which is hereby incorporated by reference herein, discloses a pump system having a piston pump. The piston pump has a cylinder block with an inlet port, an outlet port, and a plurality of cylinders. Each cylinder in the plurality of cylinders is connected to the inlet port by an inlet passage and to the outlet port by an outlet passage. The piston pump has a plurality of pistons disposed in the plurality of cylinders. A drive shaft drives the pistons within the cylinders. A throttle member independently throttles flow in each inlet passage. The pump system has an electrohydraulic actuator governing movement of the throttle member.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

According to one example, a method is provided for machinery having hydraulic actuators performing work with fluid supplied from radial hydraulic pumps. The method includes aligning a plurality of radial hydraulic pumps end-to-end along a common driveshaft axis to form a multi-pump assembly having a plurality of piston/cylinder units extending in a radial direction about the driveshaft axis, and associating two or more piston/cylinder units in the plurality of piston/cylinder units with one another to form multiple piston/cylinder groups. Individual output flows from the two or more associated piston/cylinder units are combined into a common output flow for each respective piston/cylinder group. The common output flow from each respective piston/cylinder group is varied by throttling inlet flow to the two or more associated piston/cylinder units in each piston/cylinder group. The common output flow is directed from each respective piston/cylinder group to a hydraulic actuator on the heavy machinery so as to control a direction of movement of the hydraulic actuator.

In another example, a system for machinery having hydraulic actuators performing work with fluid supplied from radial hydraulic pumps is provided. Radial hydraulic pumps are aligned end-to-end along a common driveshaft axis to form a multi-pump assembly having a plurality of piston/cylinder units extending in a radial direction about the driveshaft axis, and two or more piston/cylinder units in the plurality of piston/cylinder units are associated with one another to form multiple piston/cylinder groups. The system includes a plurality of control valves, each control valve in the plurality of control valves combining individual output flows from the two or more associated piston/cylinder units into a respective common output flow for each respective piston/cylinder group. A plurality of flow control devices is also provided, and each flow control device in the plurality of flow control devices varies the common output flow from each respective piston/cylinder group by throttling inlet flow to the two or more associated piston/cylinder units in each respective piston/cylinder group. Each respective common output flow is directed from each respective piston/cylinder group to a hydraulic actuator on the heavy machinery so as to control a direction of movement of the hydraulic actuator.

BRIEF DESCRIPTION OF THE DRAWINGS

The present disclosure is described with reference to the following Figures. The same numbers are used throughout the Figures to reference like features and like components.

DETAILED DESCRIPTION OF THE DRAWINGS

Figure 1:
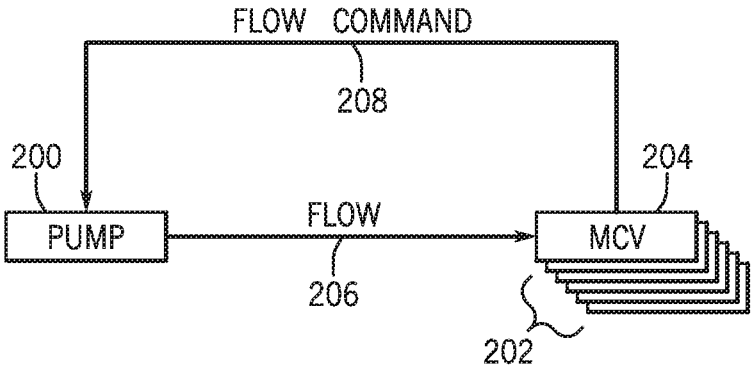
FIG. 1 (PRIOR ART)
FIG. 1 is a schematic showing a prior art system for controlling multiple functions of heavy construction equipment.

Referring to FIG. 1, hydraulic systems in heavy equipment used, for example, for off-road construction use hydraulic fluid to move various components of the equipment. Such systems can include one or more pumps 200, one or more hydraulic actuators 202 (cylinders and/or motors) for performing machinery functions, and a main control valve (MCV) 204 used to route hydraulic fluid from the pump(s) 200 to the actuator(s) 202. The pump(s) 200 can be radial or axial hydraulic piston pumps. The pump(s) 200 can include a mechanism that controls the flow 206 and/or pressure of hydraulic fluid delivered by the pump(s) 200 to the hydraulic system. The mechanism can be hydro-mechanical or electronic, and can be independent from the main control valve 204. The MCV 204 can supply a hydraulic signal, or a sensor can provide an electronic signal, indicating the amount of flow and/or the pressure desired from the pump(s) 200 (i.e., a "flow command" 208). The MCV 204 is also used for directional control of the actuator(s) 202 by routing hydraulic fluid to various workports connected to the actuator(s) 202.

Figure 2:
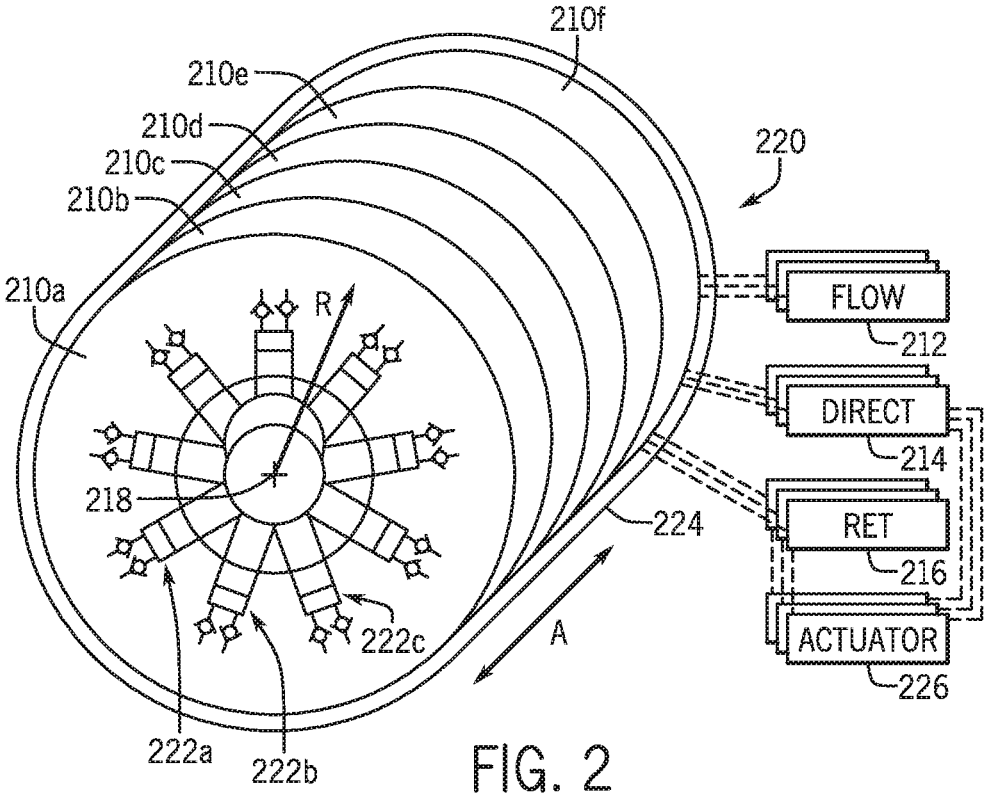
FIG. 2 is a schematic showing a system for controlling multiple functions of heavy construction equipment according to the present disclosure.

Through research and development, the present inventors have realized that radial piston pumps generally produce significantly better pumping efficiency than similarly-sized axial pumps. Referring to FIG. 2, multiple radial pumps 210*a*-210*f* are shown packaged together. The radial nature of the pistons in the pumps allows for space-effective packaging of multiple pumps by aligning the plurality of radial hydraulic pumps 210*a*-210*f* end-to-end along a common driveshaft axis 218 to form a multi-pump assembly 220 having a plurality of piston/cylinder units 222*a*, 222*b*, 222*c*, etc. extending in a radial direction "R" about the driveshaft axis 218. Note that although the piston/cylinder units 222*a*, 222*b*, 222*c*, etc. are shown only in radial pump 210*a*, the same number of piston/cylinder units are spaced radially about the driveshaft axis 218 in each of the pumps 210*b*-210*f*. Thus, for example, if nine piston/cylinder units 222*a*, 222*b*, 222*c*, etc. are provided in each pump 210*a*-210*f*, the multi-pump assembly would contain fifty-four piston/cylinder units 222*a*-222*x* in total (where "222*x*" represents the fifty-fourth piston/cylinder unit in this example). Each of the pumps 210*a*-210*f* can be situated within a common pump housing 224 that extends in an axial direction "A" that is parallel to the driveshaft axis 218, as shown herein. Optionally, the pumps 210*a*-210*f* can be split into two or more common pump housings.

According to the present disclosure, two or more piston/cylinder units 222*a*-222*x* in the plurality of piston/cylinder units 222*a*-222*x* are associated with one another to form multiple piston/cylinder groups. Each piston/cylinder group can extend in one of (a) the axial direction A of the common pump housing 224, parallel to the driveshaft axis 218; or (b) the radial direction R, around a circumference of the common pump housing 224. Taking the latter arrangement as an example, a radial grouping of piston/cylinder units would combine all nine piston/cylinder units 222*a*, 222*b*, 222*c*, etc. in the pump 210*a* into a single piston/cylinder group. An axial grouping of piston/cylinder units would combine piston/cylinder unit 222*a* in pump 210*a* with a corresponding piston/cylinder unit in each of the other pumps 210*b*, 210*c*, 210*d*, 210*e*, 210*f* together into a piston/cylinder group.

This multi-pump packaging provides an opportunity for providing a piston/cylinder group per-function on heavy equipment, such as off-road construction machinery. This in turn allows for the elimination of throttling between functions, as each piston/cylinder group can be provided with its own flow control 212, direction control 214, and return metering control 216 assemblies. Only three of each of these assemblies 212, 214, 216 are shown schematically in FIG. 2 for purposes of clarity; however, it should be understood that six of each of these assemblies could be provided if the piston/cylinder units 222*a*-222*x* were grouped radially, or nine of these assemblies could be provided if the piston/cylinder units 222*a*-222*x* were grouped axially. Such space-effective packaging can also include different packaging of the system's MCVs, as will be described in more detail herein below. For example, the multi-pump assembly 220 may include a plurality of control valves 214, each control valve in the plurality of control valves 214 combining individual output flows from the two or more associated piston/cylinder units 222*a*-222*x* into a respective common output flow for each respective piston/cylinder group. A plurality of flow control devices 212 may also be provided, wherein each flow control device in the plurality of flow control devices 212 varies the common output flow from each respective piston/cylinder group by throttling inlet flow to the two or more associated piston/cylinder units 222*a*-222*x* in each respective piston/cylinder group. Each respective common output flow can then be directed from each respective piston/cylinder group to a hydraulic actuator 226 on the heavy machinery so as to control a direction of movement of the hydraulic actuator 226. Although only three hydraulic actuators 226 are shown in FIG. 2, more can be provided.

As mentioned, the piston/cylinder units 222*a*-222*x* in the radial pumps 210*a*-210*f* can be grouped and controlled radially or axially. If radially grouped (see FIG. 3), flow control can be provided by a valve plate and throttle mechanism. Directional control can be accomplished by way of an A/B directional spool (see FIGS. 5-12 and 16-19) or by way of pilot operated check valves (see FIGS. 20, 21). In both cases, return metering can be provided via a directional spool or independently. If axially grouped, (see FIG. 13), flow control to the pumps can be provided by a spool valve with A/B directional control (see FIGS. 14-19). Return metering can be accomplished by way of the same spool or independently. Each of these examples will be described in further detail herein below.

One particular example of a piece of heavy equipment that can benefit from axial alignment or stacking of radial hydraulic pumps into a common pump housing is an excavator, although it should be understood that the examples about to be provided below are not limited to use in an excavator. Rather, an excavator is used to provide examples of how axially-stacked radial pumps can be used to provide better hydraulic efficiency while actuating one or more functions of the heavy equipment. For instance, one source of inefficiency in an excavator is the pressure drop required to control flow to two or more actuators connected to the same pump when their pressure requirements are different. It is common with traditional control valves (see 204, FIG. 1) to throttle fluid from a high pressure pump 200 to the lower pressure actuator 202 to control the flow. To reduce these throttling losses, it is desirable to use one pump and one set of valves for each actuator to avoid these different operating pressure requirements necessitating throttling losses. However, due to axial pump inefficiencies and the geometry of an axial pump preventing reasonable system packaging, the overall efficiencies for one axial pump per function are lower than desired.

Examples of the present disclosure show pumps with alternative rotary groups, outlet gallery arrangements, and valve arrangements that provide similar functionality. Various hydraulic circuits that can be employed in connection with the pumps are also disclosed.

Figure 3:
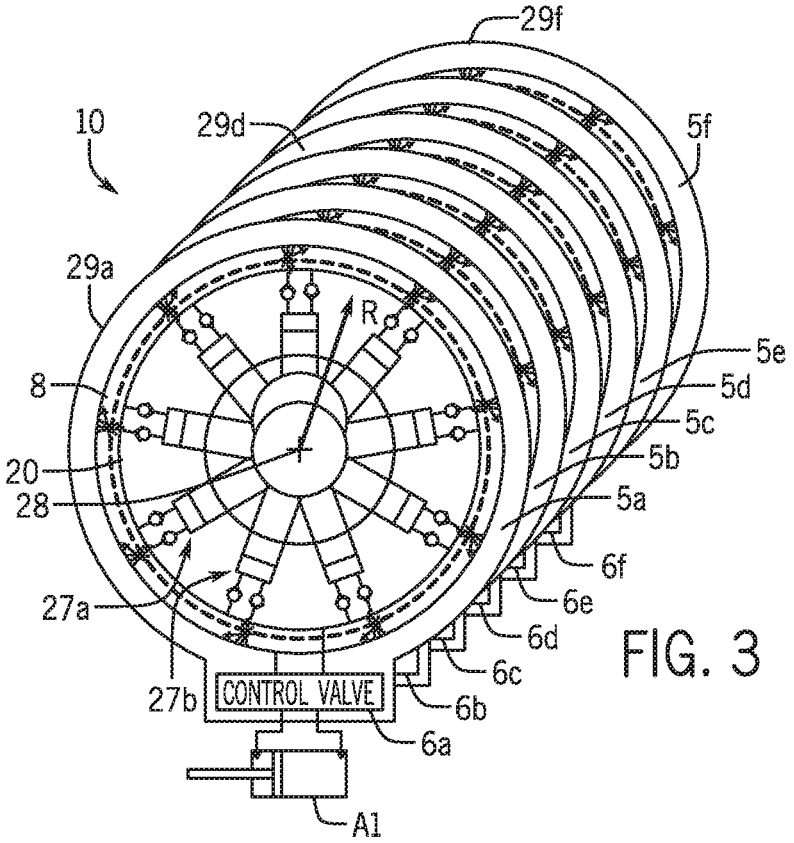
FIG. 3 is a schematic showing a plurality of axially aligned radial piston pumps, wherein functions are associated with a radial grouping of piston/cylinder units.

One way to package a number of radial pumps together in a compact manner with radial groupings of piston/cylinder units will be described now with respect to FIGS. 3 and 4, and includes changing the orientation of the outlet checks and outlet galleries. (Compare the compact architecture of the pump of FIG. 4 with the layered architecture of a throttle plate, inlet check, piston/cylinder set, and outlet check shown in U.S. Pat. Nos. 8,926,298 and 9,062,665, incorporated by reference herein above.) Another option is to locate the inlet check valves in a radial orientation as well, as shown in FIG. 3, which may provide additional cost, assembly, performance, and/or packaging benefits. The options shown in both FIGS. 4 and 3 allow for more axial compactness of a stacked assembly 10, while still allowing for association of one function with one piston/cylinder group.

FIG. 3 illustrates one example in which each piston/cylinder group 5*a*-5*f* extends in the radial direction R, around a circumference of the multi-pump assembly 10. For example, note how the inlet check valves in each piston/cylinder unit 27*a*, 27*b*, etc. in pump 29*a* are commonly associated with inlet gallery 8, and all of the outlet check valves in pump 29*a* are commonly associated with outlet gallery 20. Inlet and outlet checks in each of the other pumps 29*b*-29*f* are similarly associated with common inlet and outlet galleries per piston/cylinder group. This arrangement allows one radial pump (e.g. 29*a*-29*f*) to be associated with each actuator, and a spool or other type of independent metering device to be provided for each actuator. For all six actuators of the heavy machinery (only one of which is shown at A1), there is an independent radially-associated piston/cylinder group 5*a*-5*f* and control valve 6*a*-6*f*. (Note that fewer or more actuators could be provided for a different type of heavy equipment, and thus fewer or more piston/cylinder groups and control valves could be provided.)

Figure 4:
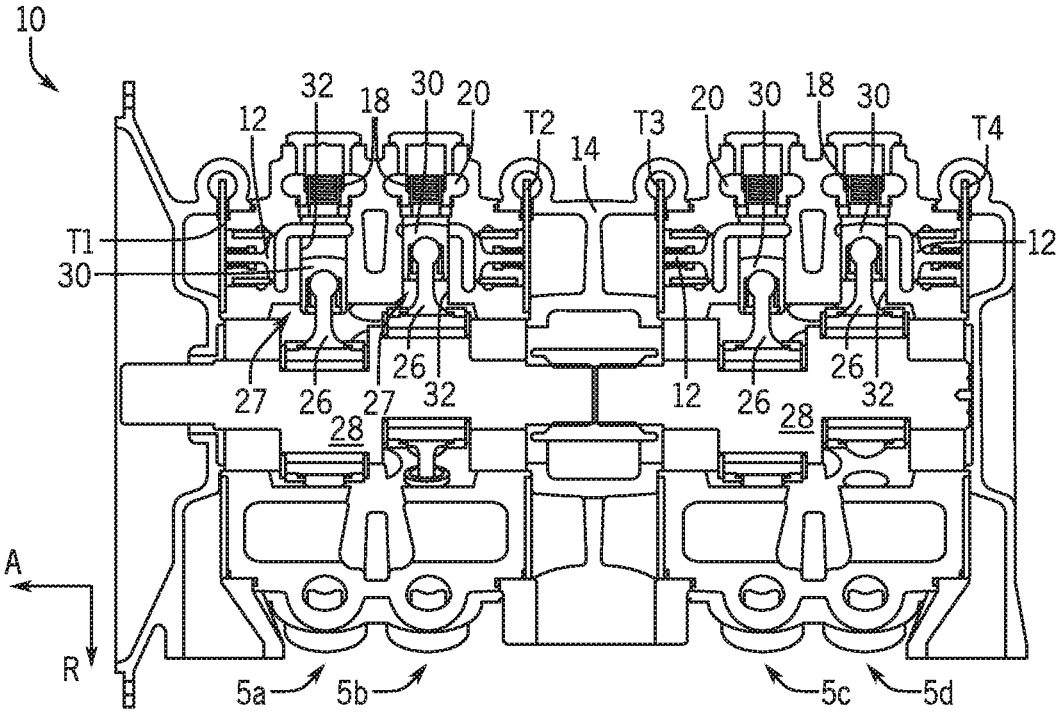
FIG. 4 illustrates a 4-bank radial pump according to the present disclosure.

FIG. 4 illustrates a partial cross section of the multi-pump assembly 10 according to one example of the present disclosure, having four pumping banks stacked in an axial direction A within a common pump housing 14 and four radially defined piston/cylinder groups 5*a*-5*d*. The multi-pump assembly 10 also includes four individual variable controls (throttle plates T1-T4) regulating flow to four functions with virtually no wasted pressure drop (although it should be understood that fewer or more than four pumps could be provided as one assembly). The throttle plates T1-T4 and their method of operation are described in the above-incorporated U.S. Pat. Nos. 8,926,298 and 9,062,665, and therefore will not be more fully described herein. Each piston/cylinder group 5*a*-5*d* includes several piston/cylinder units 27, each piston/cylinder unit 27 including a piston rod 26 coupled to a drive shaft 28 at one end and a piston 30 at the other end. The pistons 30 move radially toward and away from the drive shaft 28 within cylinders 32. On the downstroke of a piston rod 26, fluid flows through an inlet check 12 into the cylinder 32. On the upstroke of a piston rod 26, fluid is pushed out of the cylinder 32 by the piston 30 through an outlet check 18. Other components not specifically described herein are similar to those discussed in the above-incorporated patent and applications.

The outlet checks 18 are provided in line with each respective radial piston/cylinder group 5*a*-5*d*, and an outlet gallery 20 passes over each piston/cylinder group 5*a*-5*d*. The location of the outlet gallery 20 and outlet port (not shown) on the perimeter of the pump housing 14 helps provide a compact package. The specific location of the outlet gallery 20 and outlet port also facilitates coupling of valving directly to the pump housing 14, as will be described with respect to FIG. 5 below, which valving would otherwise have to be provided as external devices. In addition, the close proximity of the outlet galleries 20 to the flow control throttling mechanisms T1-T4 allows both outlet directional control and variable flow control devices to be mechanically or hydraulically coupled in a single embodiment. Thus, the present disclosure provides for an axially compact combination of multiple radial piston pumps with integrated valving. Multiple schematics and physical valve arrangements for such an assembly are described below.

Figure 5:
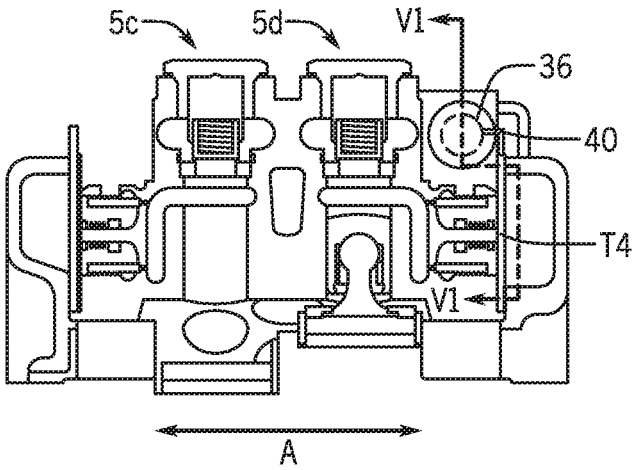
FIG. 5 illustrates a portion of the pump of FIG. 4 with a control valve incorporated into the pump housing.
Figure 6:
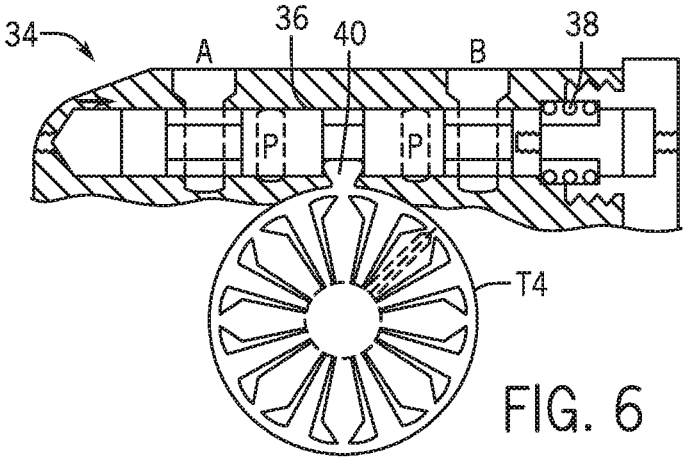
FIG. 6 is a schematic showing a partial cross section of FIG. 5, taken along the line VI-VI.
Figure 7:
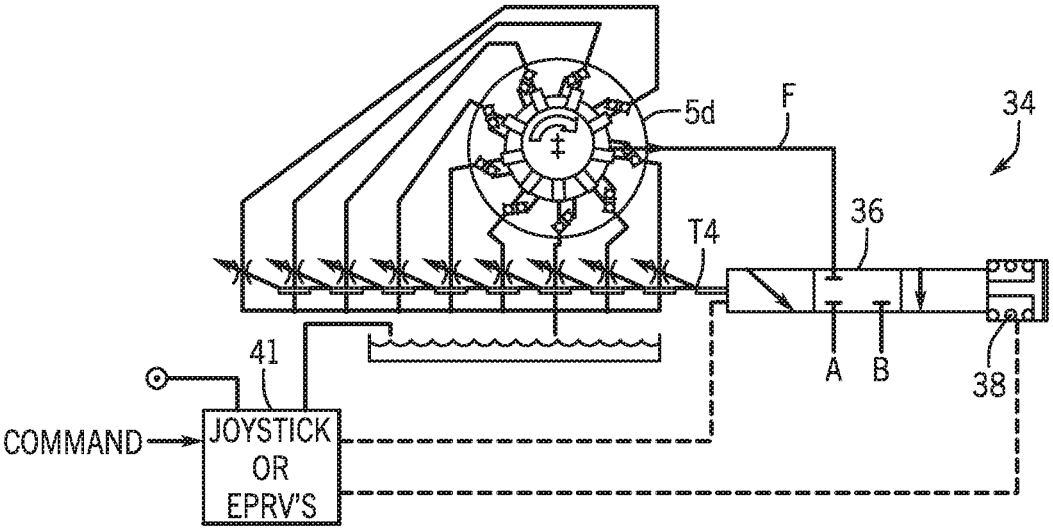
FIG. 7 is a schematic showing a 3-way directional valve mechanically coupled to a throttle member.

In FIGS. 5-7, in one example, a 3-way directional main control valve 34 is mechanically connected to a bi-directional flow control throttle member T4 controlling flow to one pumping group or bank, here to piston/cylinder group 5*d*. For a given desired flow output to the A or the B port of an actuator, a pilot pressure will be communicated to a spool 36 working against a spring 38 as shown in FIGS. 6 and 7. The resulting spool position will control the amount of flow through a mechanically coupled throttle mechanism T4 shown as a valve plate. The spool position will also direct the output flow (line F, FIG. 7) of the piston/cylinder group 5*d* to either the A or the B port of a hydraulic actuator on the heavy machinery. FIG. 5 shows how the spool 36 can be positioned perpendicular to the axial stacking direction A, and can be mechanically coupled to the throttle plate T4 via a tab 40 (see also FIG. 6), such that movement of the spool 36 causes movement of the throttle plate T4.

Although only one control valve 34 and flow control device T4 are shown in FIGS. 5-7, it should be understood that the same arrangement can be provided for each of the other piston/cylinder groups 5*a*, 5*b*, and 5*c* shown in FIG. 4. Thus, FIGS. 5-7 show an example in which a given control valve 34 and a given flow control device T4 associated with a given piston/cylinder group 5*d* are mechanically coupled to one another, thereby enabling the common output flow from the given piston/cylinder group 5*d* and the direction of movement of a given hydraulic actuator associated with the given piston/cylinder group 5*d* to be varied simultaneously. For example, a single spool 36 can be used to vary the common output flow from the given piston/cylinder group 5*d* and to vary the direction of movement of a given hydraulic actuator simultaneously. Such flow control and directional control can be commanded by way of input to a joystick or an electric pressure reducing valve (EPRV) 41 (FIG. 7).

Figure 8:
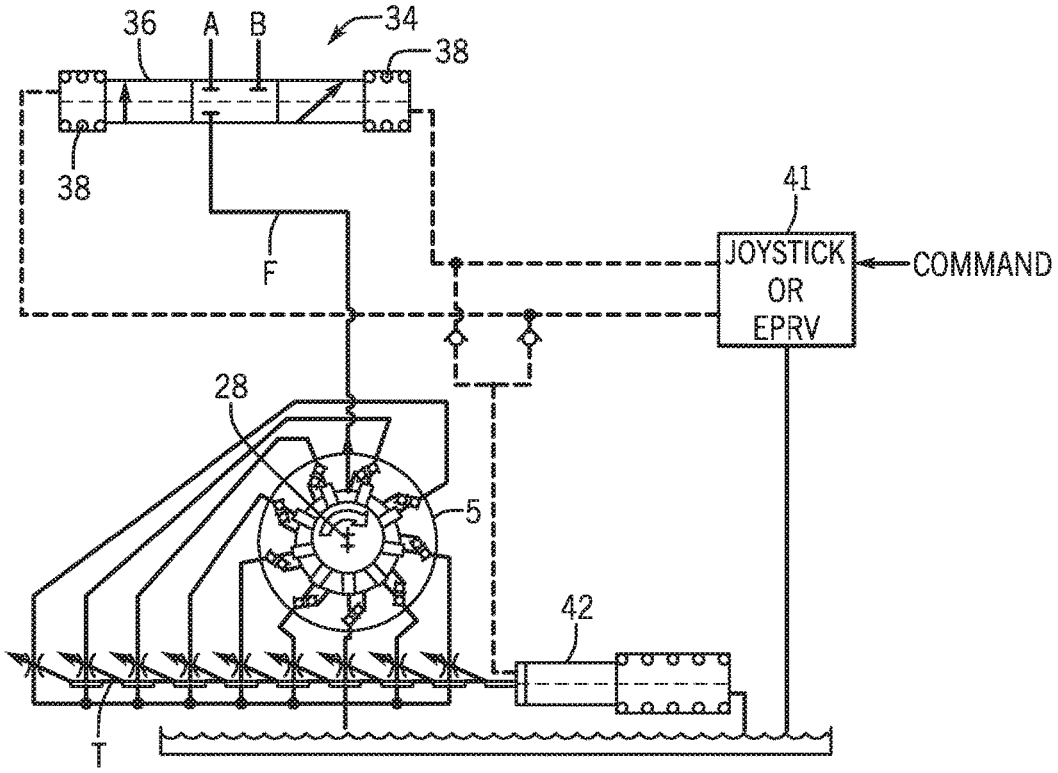
FIG. 8 is a schematic showing a 3-way directional valve hydraulically coupled to a throttle member.
Figure 9:
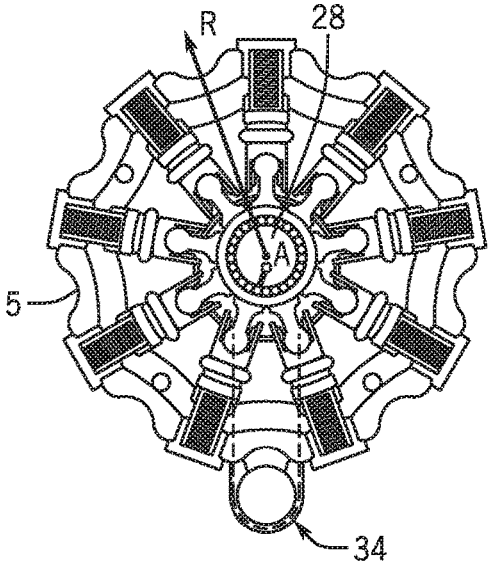
FIG. 9 is a schematic showing where a valve that could be used to implement the circuit of FIG. 8 could be located in a pump housing.

FIGS. 8 and 9 show a similar embodiment, but in which a 3-way directional control valve 34 is hydraulically, rather than mechanically, connected to the flow control throttle member T. For a given desired flow output to the A or the B port of a hydraulic actuator on the heavy machinery, a pilot pressure will be communicated to the spool 36 working against a spring 38 as shown in FIG. 8. The same pilot pressure command input via the joystick or EPRV 41 is also hydraulically connected to a piston 42 that controls the position of the throttle member T, which in turn controls the flow of the piston/cylinder group 5. The hydraulic connection to control the position of the throttle member T allows for an additional device such as an additional electric pressure reducing valve (EPRV) or a hydraulic compensator to be added to make independent corrections to the flow command. For example, a correction to the flow command could be used for power control on heavy machinery by reducing the flow of the piston/cylinder group 5 when the output power exceeds the capability of the engine.

The hydraulic connection to control the position of the throttle member T also allows the directional control valve 34 and the throttle member T to use different spring and stroke combinations. In addition, this arrangement provides the flexibility to locate the directional control valve 34 parallel to the axis of the drive shaft 28 (i.e., in the axial direction A) which can make the pumping group more axially compact. See FIG. 9. Thus, FIGS. 8-9 show an example in which a given control valve 34 and a given flow control device T associated with a given piston/cylinder group 5 are hydraulically coupled to one another, thereby enabling the common output flow from the given piston/cylinder group 5 and the direction of movement of a given hydraulic actuator associated with the given piston/cylinder group 5 to be varied simultaneously. Such flow control and directional control can be commanded by way of input to a joystick or an electric pressure reducing valve (EPRV) 41.

Figure 10:
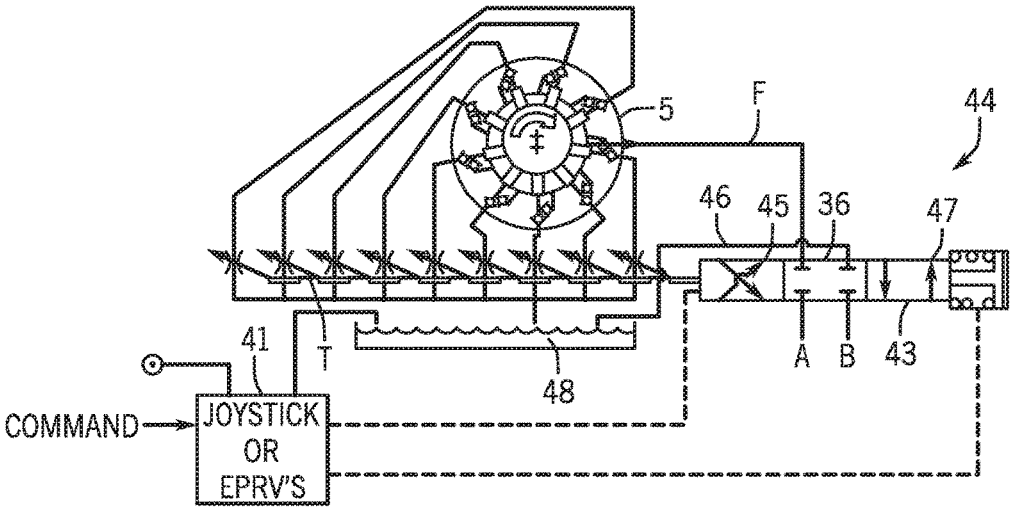
FIG. 10 is a schematic showing a 4-way valve mechanically coupled to a throttle member.
Figure 11:
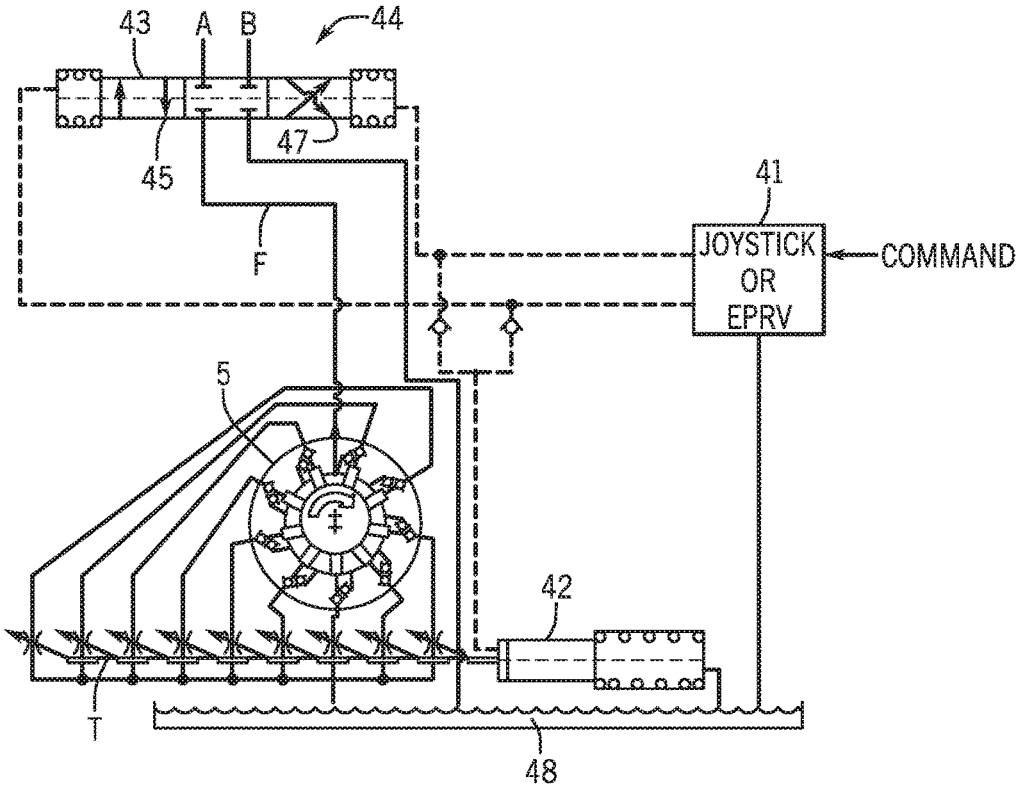
FIG. 11 is a schematic showing a 4-way valve hydraulically coupled to a throttle member.

FIGS. 10 and 11 show another example, in which a 4-way directional main control valve 44 is mechanically connected to the bi-directional flow control throttle member T. This arrangement is similar to that shown in FIGS. 5-7, but adds a return passage 46 and spool lands 45, 47 for metering return flow from the hydraulic actuator. The 4-way control valve thus acts as a flow restricting mechanism between the hydraulic actuator on the heavy machinery and tank 48. In one example, return metering can be used to control the speed of an over running load, such as a gravity-lower function. The return fluid can be returned directly into to the tank 48 of the assembly, or directed to a cooling circuit. Note that a spool 43 serving as the main control valve 44 could be installed in the multi-pump assembly in the same way as that shown in FIG. 9, i.e. along the outer surface of the assembly between two piston/cylinder units and extending in the axial direction A.

FIG. 11 shows a 4-way directional control valve 44 that is hydraulically connected to the flow control throttle member T by way of a piston 42. This arrangement has the advantages of both the examples of FIGS. 8-9 and 10.

Figure 12:
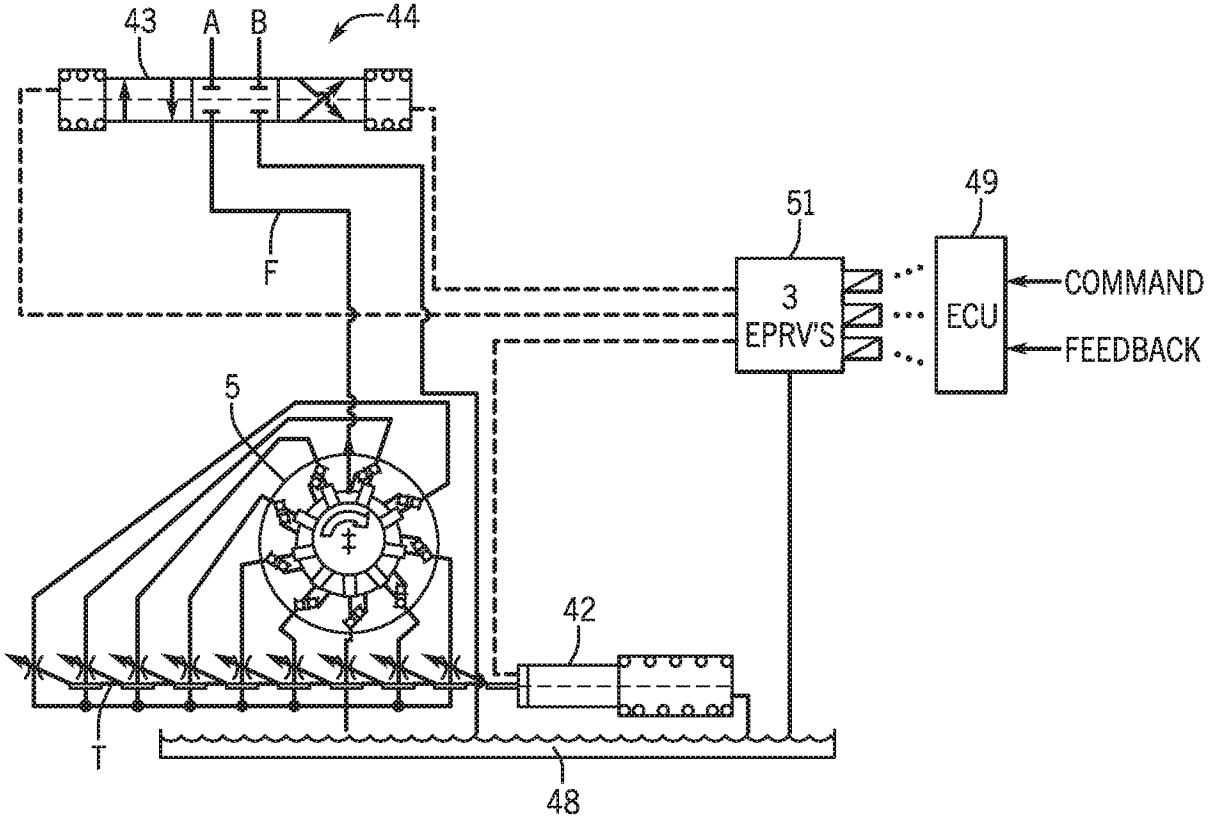
FIG. 12 is a schematic showing a hydraulic circuit for independent valve and throttle control.

Additions to the hydraulic components and circuits shown in FIGS. 5-11 can be included to provide power control and other flow compensation. Reducing flow based on power available from a prime mover is common, and the hydraulic components and circuits shown in FIGS. 5-11 can all accomplish power control functions using an electronic control unit (ECU) and electro-hydraulic actuation. Additionally, the circuits shown in FIGS. 8 and 11 can be modified to control the pump flow independently of the directional control valve by adding an ECU command. See FIG. 12, which shows an ECU 49 in signal connection with EPRVs 51 that control hydraulic fluid flow into and out of the spool 43 to control direction of the hydraulic actuator and into and out of the piston 42 to control throttling. FIG. 12 shows an example in which each control valve 44 is independent of each flow control device T, thereby enabling the common output flow from a given piston/cylinder group 5 and the direction of movement of a given hydraulic actuator associated with the given piston/cylinder group 5 to be varied independently of one another.

Figure 13:
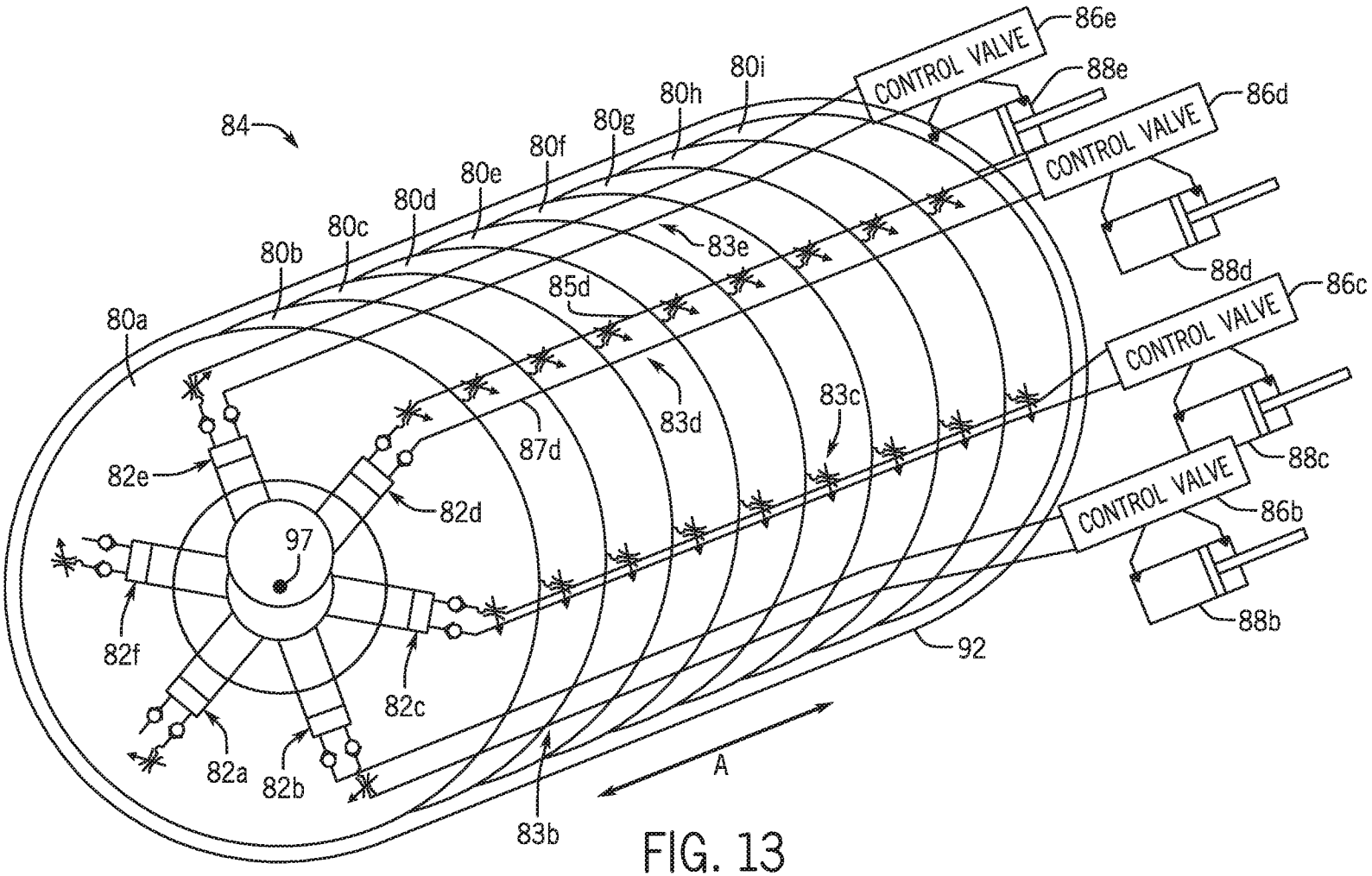
FIG. 13 is a schematic showing a plurality of axially aligned radial piston pumps, wherein functions are associated with an axial grouping of piston/cylinder units.

An alternative to the examples shown in FIGS. 3-12 is to change the association of the piston/cylinder units from radial association to axial association, as shown in FIG. 13. FIG. 13 shows the overall revised association of piston/cylinder units to functions where there are now nine radial hydraulic pumps 80*a*-80*i* with six piston/cylinder units 82*a*-82*f* in each pump. Each eccentric in the assembly 84 will be indexed by, for example, 40 degrees in an engineered sequence to manage the torque and bearing loads of the system. Neighboring radial pumps can have a maximum differential that then progresses down the axial stack. For instance, a section of 0, 200, 40, 240, 80, 280, 120, 320, 160 degrees might be a good pattern. Each piston/cylinder group extends the axial direction A of the common pump housing 92, parallel to the driveshaft axis 97. Thus, there are six axially extending piston/cylinder groups 83*a*-83*e* in the assembly 84. However, only four of these piston/cylinder groups (83*b*-83*e*) are shown due to limited space.

This construction allows for control elements of the assembly to be aligned axially (in the direction A) on the assembly 84. This enables common control valves 86*a*-86*e* (of which only 86*b*-86*e* are shown due to limited space) to be used to meter the fluid into all the respectively grouped inlet chambers (see, for example, common inlet chamber 85*d* for piston/cylinder group 83*d*), which common control valves 86*a*-86*e* can also be used for directional control of the outlet flow (see, for example, common outlet chamber 87*d*) and for workport to tank flow returning from the actuators 88*a*-88*e* (again, only four of which 88*b*-88*e* are shown).

Figure 14:
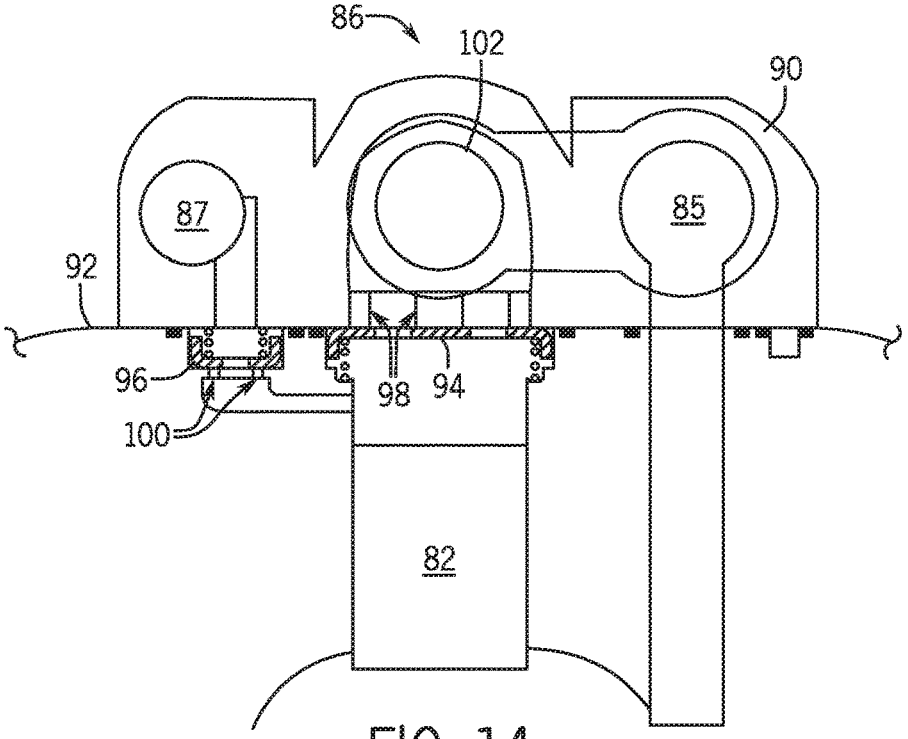
FIG. 14 is a cross sectional view of a control housing that can be used with the multi-pump assemblies shown in FIG. 13.
Figure 15:
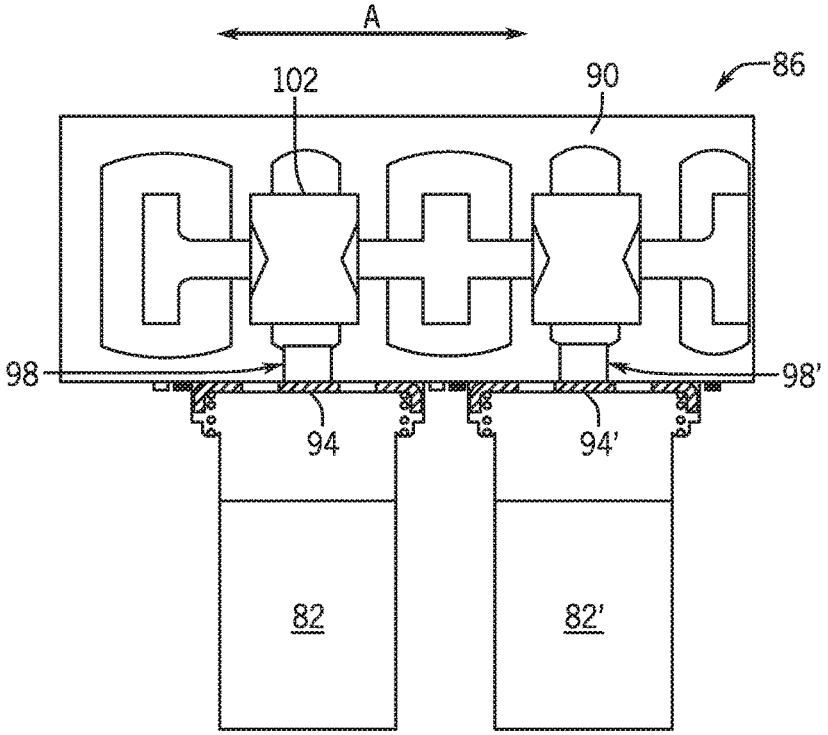
FIG. 15 is a cross sectional view of the control housing of FIG. 14, taken from a different direction.

Turning to FIGS. 14 and 15, each common control valve 86*a*-86*e* (here, generically, 86) can include a respective control housing 90 coupled to the common pump housing 92 and extending in the axial direction A that holds a single common spool 102. Only one valve 86 and control housing 90 will be described herein, it being understood that a similar description applies for the control housings (e.g.

90*a*-90*e*) associated with each piston/cylinder group 83*a*-83*e*. The long, axially-extending control housing 90 is mounted over the top of an axially-defined piston/cylinder group 83 associated with a particular function on the heavy machinery, as shown in the radial cross section of FIG. 14. Each type of control housing 90*a*-90*f* for each actuator 88*a*-88*e* could be a unique casting, in order to manage the different circuit requirements for different functions. The interface to the common pump housing 92, however, could be common for all functions of equal displacement.

In the present example, having a separate housing 90 to house all the control requirements of the pumps and valves provides an interface to create a different type of check valve assembly. For example, the inlet check valve 94 and the outlet check valve 96 can be captured between the control housing 90 and the outer surface of the pump housing 92. Thus, inlet and outlet check valves 94, 96 associated with each piston/cylinder unit 82 in a given piston/cylinder group 83 are retained by the control housing 90. Additionally, providing the check valves 94, 96 as guided shuttle disks can be used to improve their cost and speed. For both inlet check valves 94 and outlet check valves 96, there is a radial hole pattern 98, 100 machined into the seat and an opposite hole pattern machined or stamped into the check valve 94, 96. By using the pump body casting to provide the structural support for the check valves 94, 96, the moving component weight can be substantially reduced. A further advantage of the solution is that the control housing 90 provides retention of the check components, thus making assembly easy. Additionally, a seal carrier can be used to manage the sealing of all the pumping chambers.

FIG. 15 shows an axial cross section of the single spool 102 controlling multiple pumping piston/cylinder units 82, 82' combined into one group 83 and associated with one function/actuator 88. Although there may be only a low pressure available for metering flow from the sump to the inlet check valves 94, 94', because each set of lands is in parallel, the flow capacity can be maintained. The direction control of the pump outlet fluid and the workport to tank metering could be performed at the axial end of this same spool 102.

FIGS. 16-19 and 21-22 show schematics of hydraulic circuits that can be provided for the either of the assemblies 10, 84 described herein above.

Figure 16:
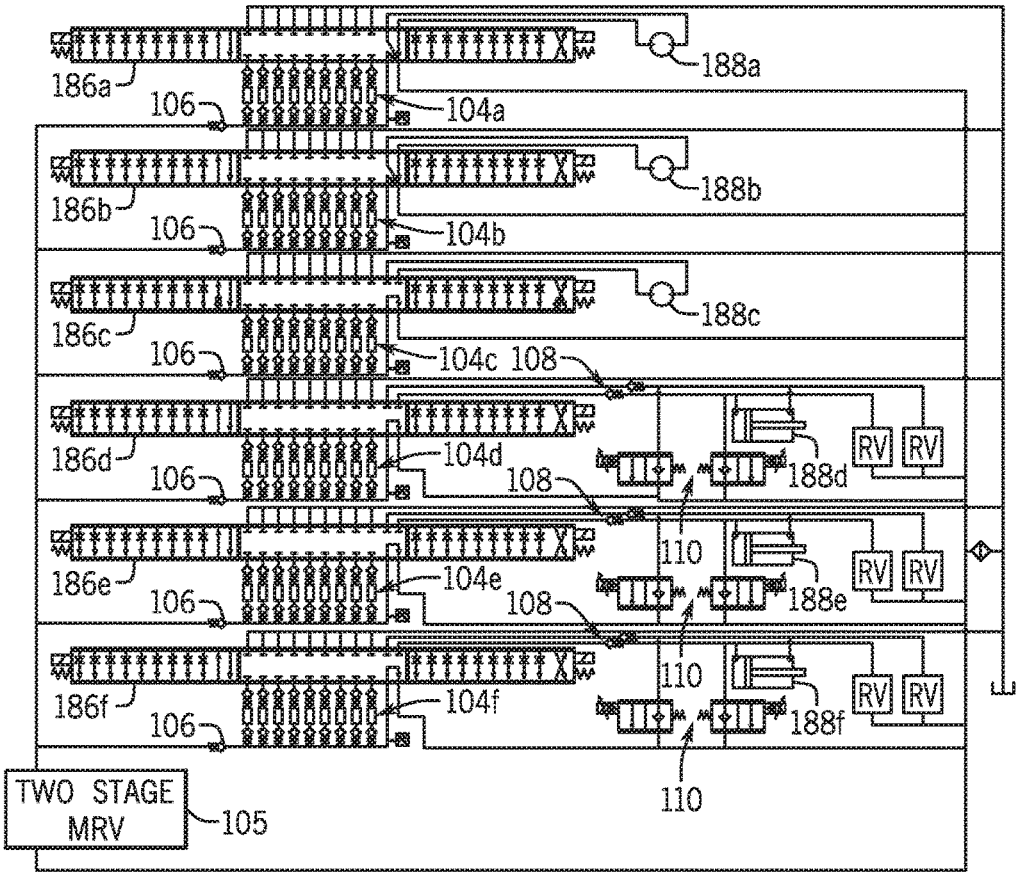
FIG. 16 is a schematic showing one example of a hydraulic circuit incorporating the multi-pump assembly of FIG. 3 or FIG. 13.

In FIG. 16, the common output flow from each respective piston/cylinder group 186*a*-186*f* is directed to a single hydraulic actuator 188*a*-188*f* on the heavy machinery, respectively. For example, the schematic shows that for each actuator (e.g. travel left 188*a*, travel right 188*b*, swing 188*c*, bucket 188*d*, arm 188*e*, boom 1880 there is a single spool 186*a*-186*f* that controls the inlet flow of hydraulic fluid to a respective piston/cylinder group 104*a*-104*f*, the directional control of fluid to either the A or B workport of the actuator 188*a*-188*f*; and the return flow on the travel 188*a*, 188*b*, and swing 188*c* functions. Check valves 106 are provided to allow a single main relief valve 105 to protect some or all of the piston/cylinder groups 104*a*-104*f* against overpressure. For example, having check valves 106*a*-106*f* downstream of two or more piston/cylinder groups 104*a*-104*f*, respectively, and a single relief valve 105 downstream of the check valves 106*a*-106*f* allows for limiting of a maximum pressure in the two or more piston/cylinder groups 104*a*-104*f*.

Load checks 108 are provided for the bucket, arm, and boom because the pump output is vented to tank when in neutral, and the load checks 108 reduce an effective volume of hydraulic fluid between a given piston/cylinder group 104*d*-104*f* and a given hydraulic actuator 188*d*-188*f* associated with the given piston/cylinder group 104*d*-104*f*. The load checks 108 are independent, however, and past the control spools 186*d*-186*f*. This allows the control spools 186*d*-186*f* to be relative high clearance in comparison to normal spool-to-bore clearances. This is important since the spool bore length could be considerably long, making manufacturing of a tight spool-to-bore clearance difficult. Another circuit advantage is that leakage is minimized on the bucket 188*d*, arm 188*e*, and boom 188*f* by having only check interfaces 108 connected to the workports. Each spool 186*d*-186*f* is therefore isolated from the actuators by the load checks 108. Additionally, the workport to tank devices 110 on these functions 188*d*-188*f* can be electrohydraulic valves or PO proportional poppet valves that provide very low leakage and high performance characteristics.

Figure 17:
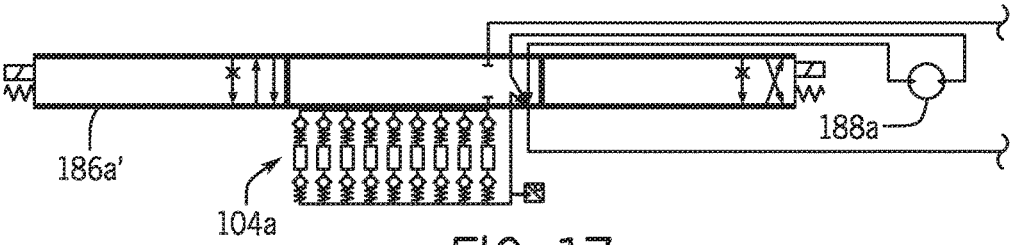
FIG. 17 is a schematic showing an alternative method for providing pump inlet throttling.

FIG. 17 shows banked inlet throttling using spool valve 186*a*' instead of throttling each inlet check in parallel, as in FIG. 16. In other words, FIG. 17 shows general throttling of the feed path to all the piston/cylinder units in a given piston/cylinder group (here, 104*a*) at once. The advantage of this method is compactness of the package. Although only the travel left function 188*a* is shown here as having banked inlet throttling, the same method could be used for all of the spool throttling assemblies 186*a*-186*f* described herein. This method could also apply to the arrangements in FIGS. 18 and 19, and to the systems described herein in which piston/cylinder units are associated radially to form piston/cylinder groups (see FIGS. 3-12), in lieu of the throttle mechanism T shown therein.

Figure 18:
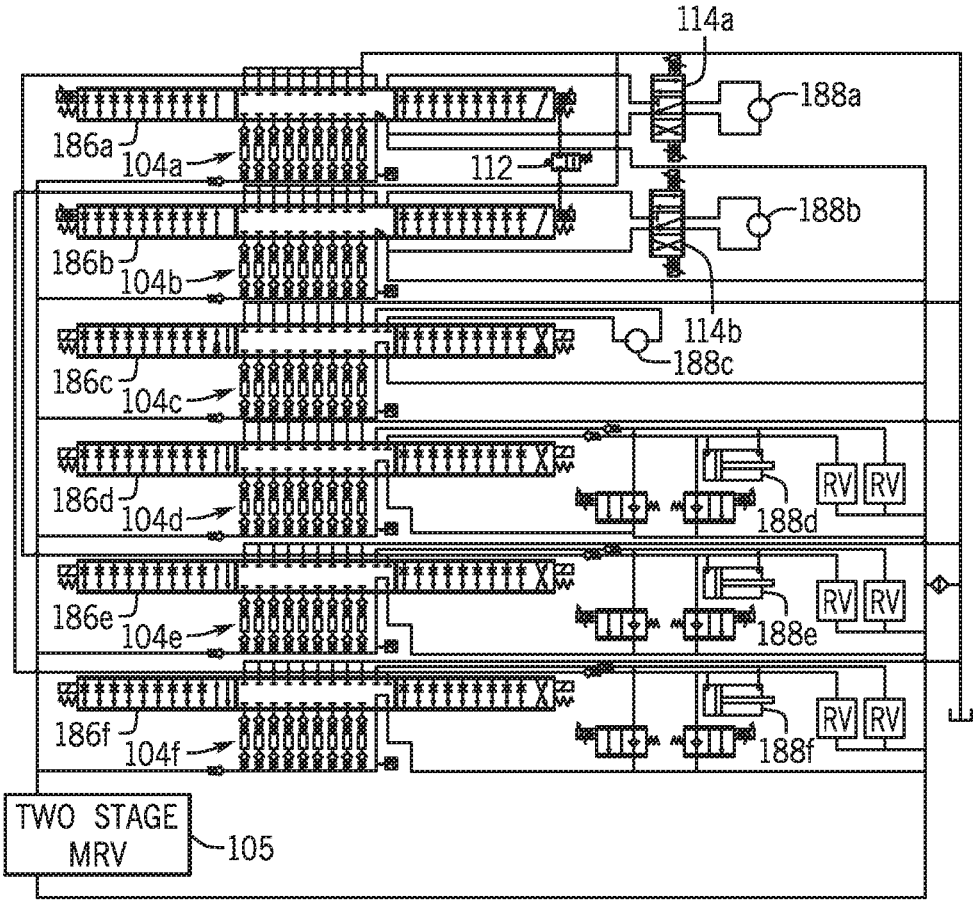
FIG. 18 is a schematic showing another hydraulic circuit incorporating the multi-pump assembly of FIG. 3 or FIG. 13.

FIG. 18 shows a circuit embodiment that enables all six piston/cylinder groups 104*a*-104*f* to have the same displacement by overlapping functionality of the travels 188*a*, 188*b* with the AI (arm in) 188*e* and BU (boom up) 188*f* functions. Generally, the BU 188*f* and AI 188*e* functions do not need two-times pump displacement while simultaneously traveling. In current two-pump systems, when travel is commanded, the boom and arm are only allowed flow from one of the pumps. Given this assumption, the present travel piston/cylinder groups 104*a*, 104*b* each have two potential consumers depending on the direction that the control spools 186*a*, 186*b* are shifted. If the control spools 186*a*, 186*b* for the travels 188*a*, 188*b* are shifted to the right, the pump flow is directed to the arm and boom respectively (flow from piston/cylinder group 104*a* is directed to arm 188*e* and flow from piston/cylinder group 104*b* is directed to boom 188*f*) to supplement the hydraulic fluid already being delivered by the primary boom and arm piston/cylinder groups 104*e*, 104*f*. Therefore, the circuit of FIG. 18 shows an instance in which the common output flow from first and second piston/cylinder groups 104*a*, 104*e* (or from 104*b* and 104*f*) is selectively combined, and the combined common output flow is directed to a single hydraulic actuator 188*e* (or 188*f*) on the machiner. When the control spools 186*a*, 186*b* are shifted to the left, pump flow is delivered to the travels 188*a*, 188*b*, with the directional control and workport to tank control being provided by an independent directional control valve 114*a* or 114*b*. If BU or AI is 100% commanded and thus drawing flow from both the upper piston/cylinder group (104*a* or 104*b*) and the primary piston/cylinder group (104*e* or 104*f*), and then the operator commands the travel, the travel spool 186*a*, 186*b* would first be brought to neutral and then controlled to the left to direct flow to the travel function 188*a*, 188*b*. This will happen in a relatively fast and seamless manner that isn't perceivable to the operator.

Another opportunity created by the circuit shown in FIG. 18 is the ability to maintain straight travel while multi-functioning. On current two-pump systems, when the travels are commanded alone, the machine will travel straight because each pump is directed to each motor independently (displacement control). When an implement function is commanded, the output of one pump is directed to both travels and the output of the second pump is directed to the implement valve. By directing one pump to both travels, the travels are provided with the same pressure and continue to travel straight by pressure control—not by displacement control. As power control or other dynamics affect pump flow from the first pump being used to drive the two travel motors, the travel motors share the flow equally since they are provided with the same pressure. With the present disclosure, when travel motors 188*a*, 188*b* are being limited (by power limiting, for instance) it is important to maintain the same flow to each travel motor 188*a*, 188*b* to ensure straight travel. If variation in the EPRV, springs, and end block machining are significant, it is a concern when limiting the flow to the travel function 188*a* or 188*b* that the flow balance between the travels 188*a*, 188*b* won't be maintained and the function will veer (no longer travel straight). One method to mitigate this performance issue is to selectively connect the pilot commands of the travels 188*a*, 188*b* together (see valve 112) when the operator is commanding straight travel so each piston/cylinder group 104*a*, 104*b* controls the same flow regardless of variations in the current control, EPRV, spring, or end mechanism. Another method to achieve the flow sharing goal between travels 188*a*, 188*b* is to connect the two travel piston/cylinder group 104*a*, 104*b* outlets through a high pressure valve and orifice (not shown) so the travels 188*a*, 188*b* flow share by having a common pressure, similar to how production systems run today.

Figure 19:
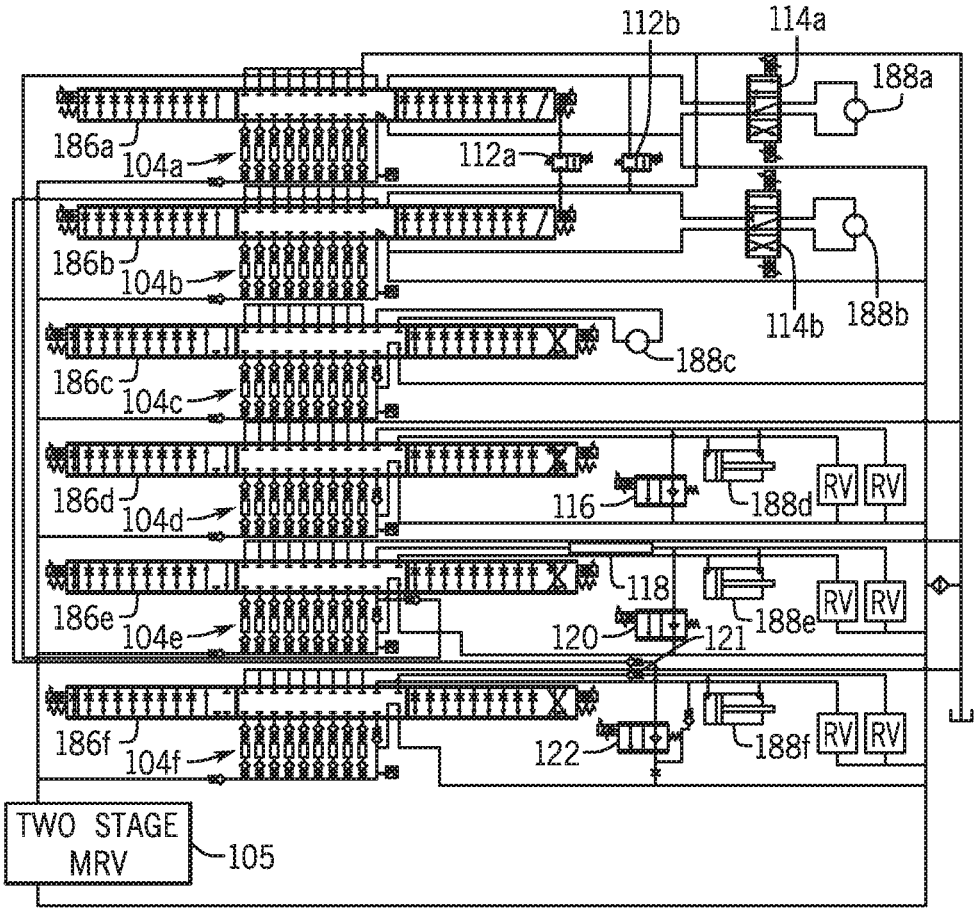
FIG. 19 is a schematic showing yet another hydraulic circuit incorporating the multi-pump assembly of FIG. 3 or FIG. 13.

Yet a further embodiment is included in FIG. 19. Differences in this embodiment from that of FIG. 18 will be described. The travel-pump-combining valve for straight travel is shown as an "or" circuit component, including a valve 112*a* that connects the pilot commands to the control spools 186*a* and 186*b* or a valve 112*b* that combines the outputs of the piston/cylinder groups 104*a*, 104*b*. The metering valve 112*b* between the first piston/cylinder group 104*a* and the second piston/cylinder group 104*b* therefore allows for selective hydraulic connection of the first and second piston/cylinder groups 104*a*, 104*b*. The arm-in/arm-out extra flow is directed through the arm control spool 186*e*. Bucket regeneration is provided for the bucket control spool 186*d* with an external disable function provided by a PO proportional poppet valve 116. (Note that a spool valve could be used instead of a PO proportional poppet valve because low leakage isn't needed.) Additionally, the arm now has a zero leak device 118 and workport to tank on the spool, with regen disable provided by workport to tank control from a PO proportional poppet valve 120. The arm could use a similar circuit to the boom where all of the rod workport to tank flow is managed through a separate device. The boom connections have also been revised to supplement flow from the travel right function 188*b* through a check valve 121 to the boom head. The boom head flow to tank is controlled to tank through a PO proportional poppet valve 122 with regeneration flow through a fixed orifice and check valve into the rod area.

Therefore, the circuit of FIG. 19 includes a metering valve 112*b* between a first piston/cylinder group 104*a* and a second piston/cylinder group 104*b* that allows for selectively combining the common output flow from the first and second piston/cylinder groups 104*a*, 104*b* and directing the combined common output flow to first and second hydraulic actuators 188*a* and 188*b* on the heavy machinery associated with the first and second piston/cylinder groups 104*a*, 104*b*.

Figure 20:
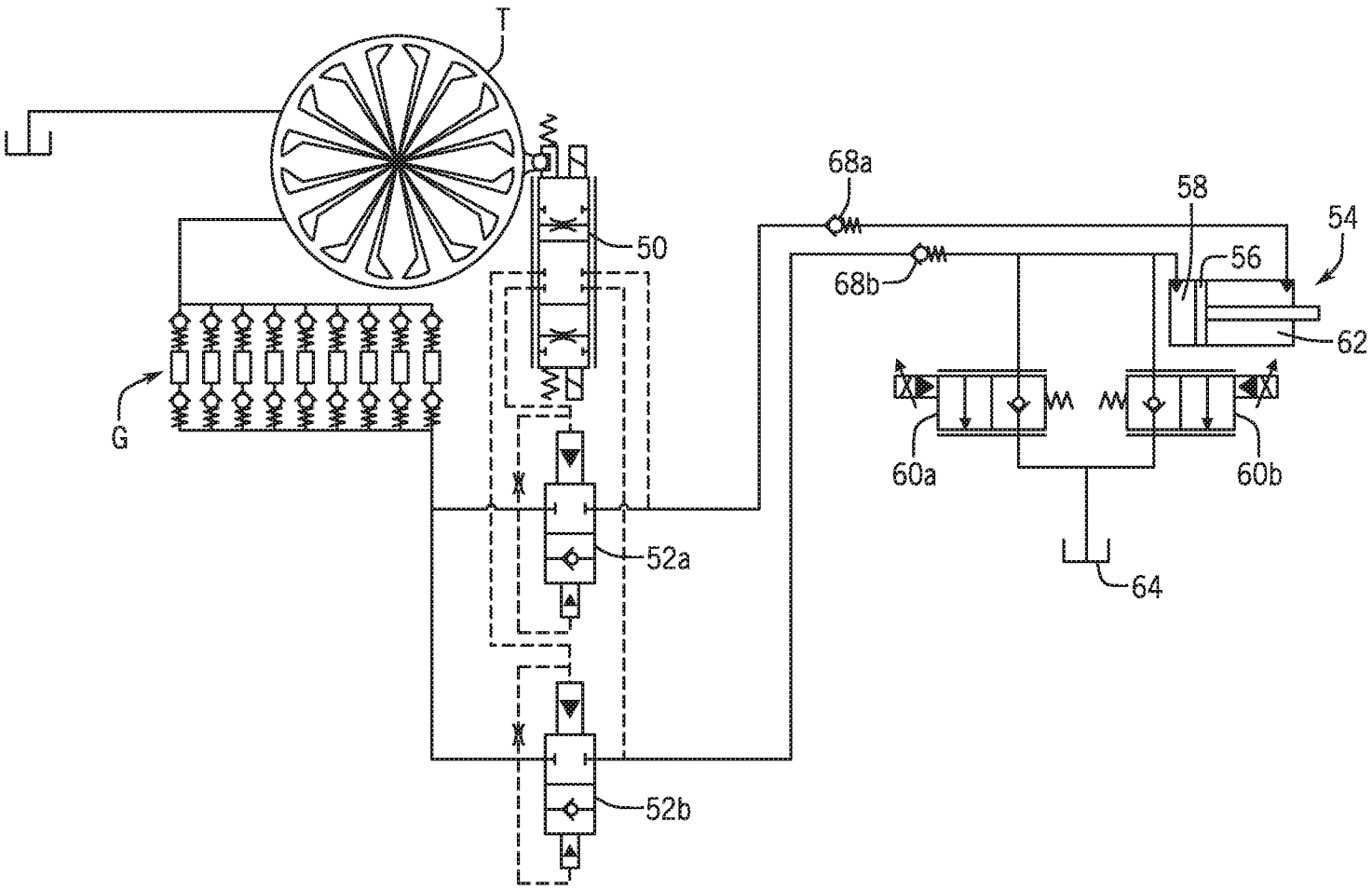
FIG. 20 is a schematic showing a hydraulic circuit for electrohydraulic control of a throttle plate.
Figure 21:
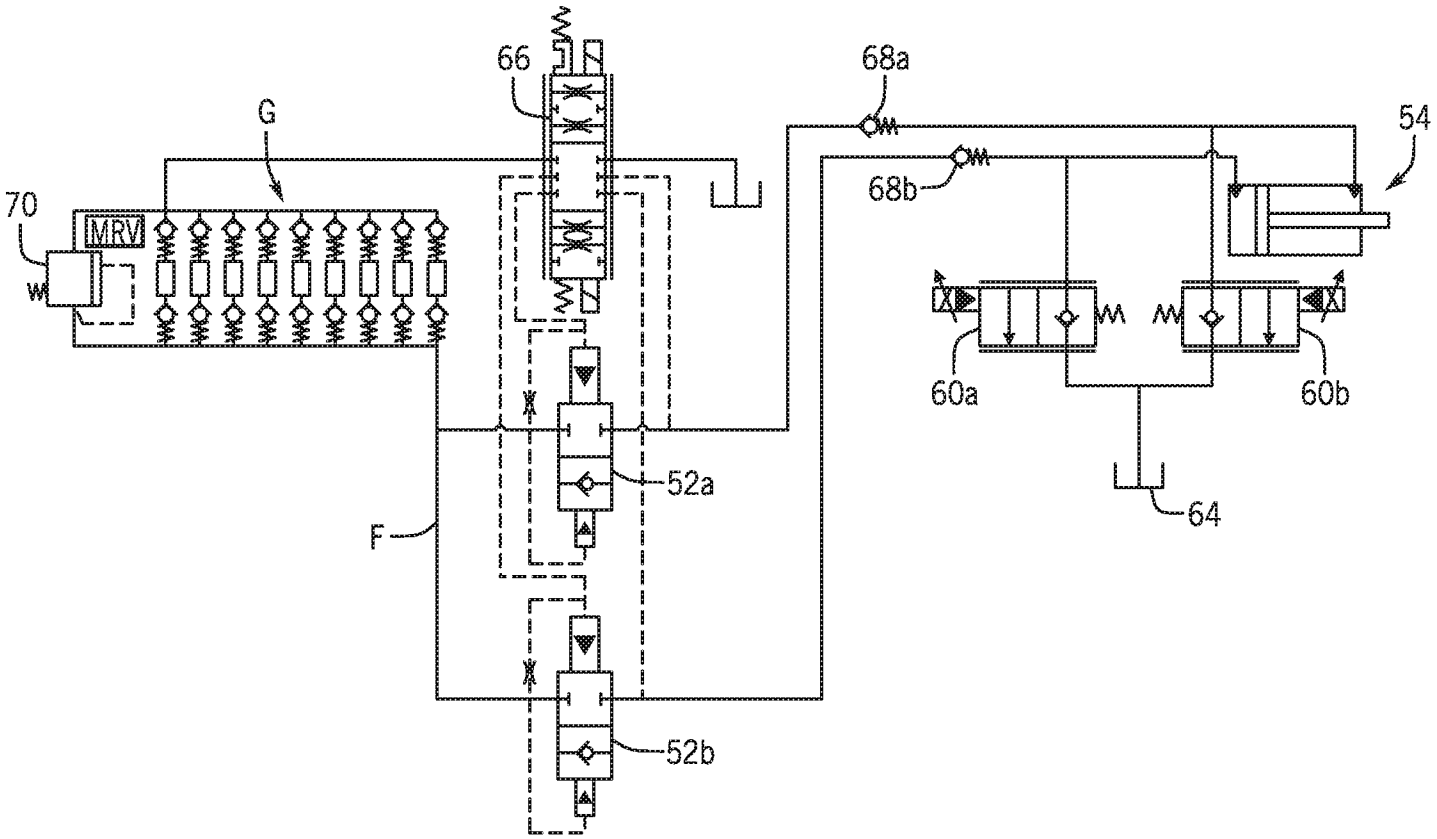
FIG. 21 is a schematic showing a hydraulic circuit for throttle control with main spool inlet throttling.
Figure 22:
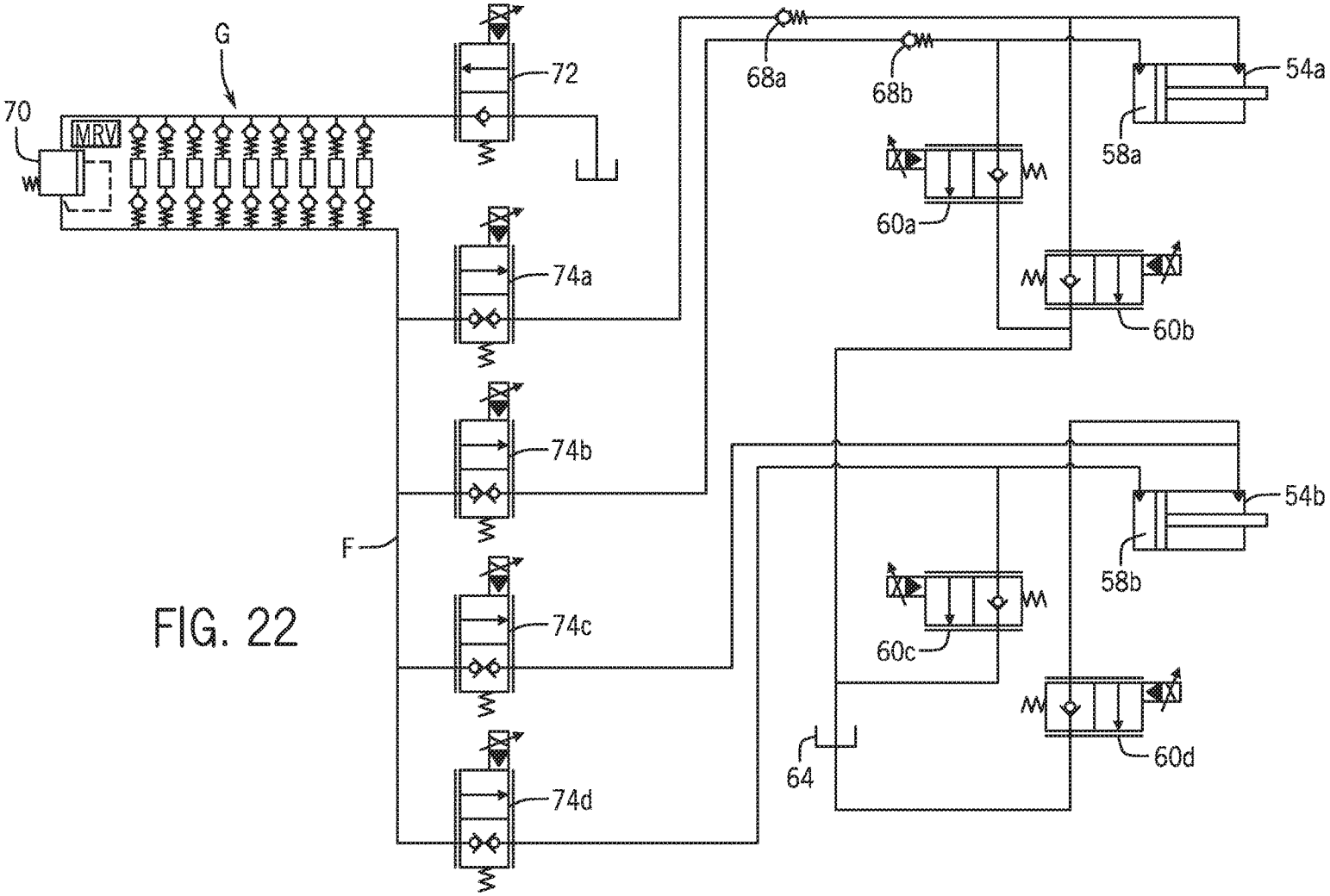
FIG. 22 is a schematic showing a hydraulic circuit for supplying hydraulic fluid to multiple functions with one pump.

Further examples of hydraulic circuits that can be used with the multi-pump assemblies 10, 84 described above, or with a single radial hydraulic pump, are described in FIGS. 20-22. FIG. 20 shows a schematic of a piston/cylinder group G with inlet throttle control, which provides variable flow. The main spool 50 is electro-hydraulically operated, and is used to position a bi-directional inlet throttle plate T for flow control, as well as to actuate pilot operated (PO) check valves 52*a*, 52*b* (in this example, pilot operated proportional poppet valves with reverse checking) for directional control of the actuator 54. The control chamber areas of the PO check valves 52*a*, 52*b* are larger than the "nose" areas, such that if the same pressure is applied to both ends, the poppet will be forced closed. By connecting the control chamber to the cylinder port, the control chamber pressure becomes less than the pressure on the nose, and the PO check valve 52*a*, 52*b* opens. In the event the cylinder port pressure is higher than the pump port pressure, the poppet in the PO check valve 52*a*, 52*b* remains closed.

To move the piston 56 to the right and thus extend the actuator 54 (for example, the boom), the bottom solenoid on the main spool 50 and the PO proportional poppet valve 60*b* on the right are energized. The main spool 50 shifts upward, causing the inlet throttle plate T to increase the pump output flow. The main spool 50 also connects the control chamber of the bottom PO check valve 52*b* to its cylinder port, allowing it to open. This connects the piston/cylinder group common output flow to the head chamber 58 of the actuator 54. At the same time, the PO proportional poppet valve 60*b* on the right (connected to the actuator rod chamber 62) connects the rod chamber 62 to tank 64. The piston 56 therefore moves to the right within the cylinder.

To retract the piston 56 to the left, the top solenoid of the main spool 50 is energized along with the left PO proportional poppet valve 60*a*, which is connected to the head chamber 58 of the actuator 54. The main spool 50 shifts downward, increasing the pump flow, and connecting the control chamber of the top PO check valve 52*a* to its cylinder port. This connects the piston/cylinder group G to the rod chamber 62. At the same time, the left PO proportional poppet valve 60*a* connects the head chamber 58 to tank 64. The piston 56 moves to the left and the boom retracts.

FIG. 20 thus shows an assembly including pilot operated check valves 52*a*, 52*b* through which the common output flow F from a given piston/cylinder group G is routed before the common output flow F from the given piston/cylinder group G reaches a given hydraulic actuator 54 associated with the given piston/cylinder group G. The size of the control chamber passages on the main spool 50 can remain small due to the small amount of flow required to open the PO check valves 52*a*, 52*b*. This allows the main spool 50 to remain small, and maintain compactness of the overall assembly 10.

FIG. 21 shows a similar circuit, with the throttle plate T replaced with inlet throttling on the main spool 66. Because all the pistons in the piston/cylinder group G are axially aligned, the main spool 66 can throttle each of the pistons in a linear motion. The main spool 66 will be larger than the main spool 50 required for the concept shown in FIG. 20, due to the larger throttling passages required; however, the throttle plate mechanism T is removed, which provides a more axially compact assembly.

Note that in both FIGS. 20 and 21, at least one load check valve 68*a*, 68*b* is located downstream of the piston/cylinder group G and upstream of the hydraulic actuator 54 associated with the piston/cylinder group G. The at least one load check valve 68*a*, 68*b* reduces an effective volume of hydraulic fluid between the piston/cylinder group G and the hydraulic actuator 54. For example, load check valves 68*a*, 68*b* are shown between the PO check valves 52*a*, 52*b* and the actuator 54. These load check valves 68*a*, 68*b* are redundant, but may be used to reduce the effective volume of fluid between the actuator 54 and the piston/cylinder group G, which may be advantageous in reducing the capacitance of the system and may help avoid undesirable actuator oscillations. A pressure relief valve 70 that limits the pressure of the pump output can also be provided in either of the circuits of FIGS. 20 and 21, although it is only shown here in FIG. 21. Alternatively, in both FIGS. 20 and 21, electro-hydraulic solenoid control of the main spool 50, 66 and cylinder to tank metering poppet valves 60*a*, 60*b* (PO proportional poppet valves) can be replaced with hydraulic pilot-operated signals, for example provided from a hydraulic joystick.

FIG. 22 shows an example in which the common output flow F from a given piston/cylinder group G and the direction of movement of a given hydraulic actuator 54*a* or 54*b* associated with the given piston/cylinder group G are electronically controlled, and in which a single piston/cylinder group G supplies multiple functions/actuators 54*a*, 54*b* on a piece of heavy machinery. In this case, the inlet throttling is shown as being accomplished with an electro-hydraulic (PO proportional poppet) valve 72, and four electro-hydraulic (PO proportional poppet) valves 74*a*-74*d* are shown connecting the internal pump supply to the two functions/actuators 54*a*, 54*b*. Each actuator 54*a*, 54*b* has its own meter-out electro-hydraulic poppet valves 60*a*-60*d* connecting head chambers 58*a*, 58*b* to tank 64. This system allows a single piston/cylinder group G to feed multiple actuators 54*a*, 54*b*, with the group's directional devices (PO poppet valves 74*a*-74*d*) being provided in the multi-pump assembly. Thus, FIG. 22 shows a portion of a multi-pump assembly in which an electro-hydraulic pilot-operated valve 72 is located upstream of at least one piston/cylinder group G and controls the common output flow F from the at least one piston/cylinder group G. Multiple electro-hydraulic pilot-operated valves 74*a*-74*d* are located downstream of the at least one piston/cylinder group G and control the direction of movement of one or more hydraulic actuators 54*a*, 54*b* associated with the at least one piston/cylinder group G. This arrangement allows for selectively directing the common output flow F from the given piston/cylinder group G to more than one hydraulic actuator 54*a*, 54*b* on the heavy machinery.

It should be understood that in each of the examples provided in FIGS. 1-22, there are a multitude of permutations that will satisfy the functions. For example, a single spool valve can be used for varying the common output flow from a given piston/cylinder group, return flow metering, and varying the direction of movement of a given hydraulic actuator simultaneously on either of a radially grouped set of piston/cylinder units or an axially grouped set of piston/cylinder units. So too could the examples of FIGS. 16-19 and 21-22 be applied to either of a radially grouped set of piston/cylinder units or an axially grouped set of piston/cylinder units. Additionally, the circuits associated with any single piston/cylinder group shown herein could be applied to all piston/cylinder groups in a single multi-pump assembly, or combinations of the circuits could be applied in a single multi-pump assembly. Thus, the above examples provide only some solutions that provide intersection of packaging and circuit requirements.

Figure 23:
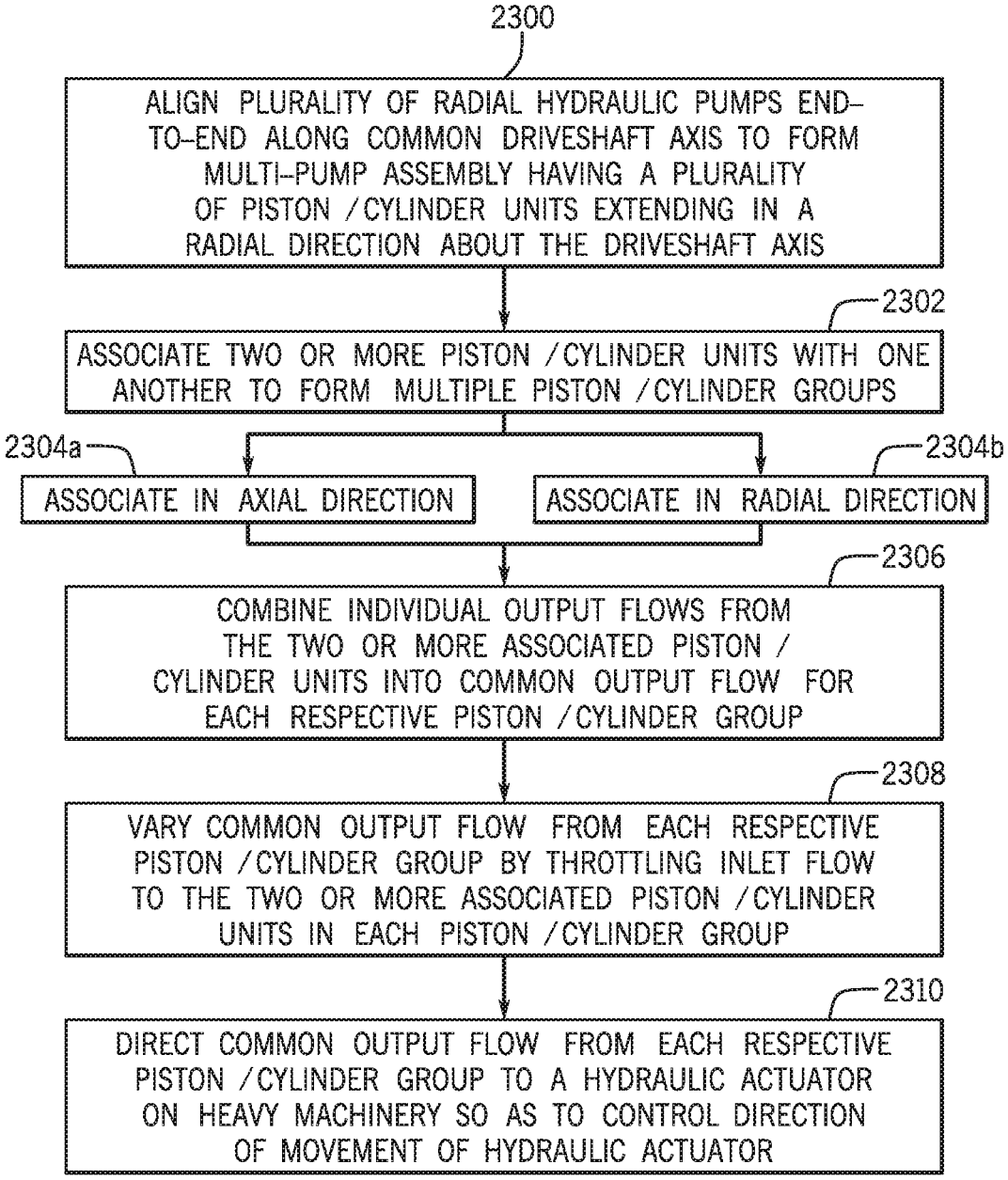
FIG. 23 illustrates a method for machinery according to the present disclosure.

Turning to FIG. 23, the present disclosure also includes a method for increasing the efficiency of heavy machinery having hydraulic actuators performing work with fluid supplied from radial hydraulic pumps. As shown at 2300, the method includes aligning a plurality of radial hydraulic pumps end-to-end along a common driveshaft axis to form a multi-pump assembly having a plurality of piston/cylinder units extending in a radial direction about the driveshaft axis. The method also includes, as shown at 2302, associating two or more piston/cylinder units in the plurality of piston/cylinder units with one another to form multiple piston/cylinder groups. The piston/cylinder units can be associated in an axial direction, such that each piston/cylinder group extends in parallel to the driveshaft axis, as shown at 2304*a*. The piston/cylinder units could otherwise be associated in the radial direction, around a circumference of the multi-pump assembly, as shown at 2304*b*. In yet another example, some piston/cylinder units can be associated radially and others can be associated axially on the same machinery. As shown at 2306, individual output flows from the two or more associated piston/cylinder units are combined into a common output flow for each respective piston/cylinder group. As shown at 2308, the common output flow from each respective piston/cylinder group is varied by throttling inlet flow to the two or more associated piston/cylinder units in each piston/cylinder group. As shown at 2310, the common output flow is then directed from each respective piston/cylinder group to a hydraulic actuator on the heavy machinery so as to control a direction of movement of the hydraulic actuator.

This written description uses examples of the present disclosure, including the best mode, and enables any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A method for machinery having hydraulic actuators performing work with fluid supplied from radial hydraulic pumps, the method comprising:

aligning a plurality of radial hydraulic pumps end-to-end along a common driveshaft axis to form a multi-pump assembly having a plurality of piston/cylinder units extending in a radial direction about the driveshaft axis;

associating two or more piston/cylinder units in the plurality of piston/cylinder units with one another to form multiple piston/cylinder groups;

providing a plurality of control valves, wherein each control valve in the plurality of control valves receives and combines individual output flows from each of the two or more associated piston/cylinder units into a respective common output flow for each respective piston/cylinder group;

varying the common output flow from each respective piston/cylinder group by throttling inlet flow to the two or more associated piston/cylinder units in each piston/cylinder group; and directing the common output flow from each respective piston/cylinder group to a hydraulic actuator on the machinery so as to control a direction of movement of the hydraulic actuator.

2. The method of claim 1, further comprising varying the common output flow from a given piston/cylinder group and varying the direction of movement of a given hydraulic actuator associated with the given piston/cylinder group simultaneously using one or more control mechanisms that are one of mechanically and hydraulically coupled to one another.

3. The method of claim 2, further comprising varying the common output flow from the given piston/cylinder group and varying the direction of movement of the given hydraulic actuator simultaneously with a single spool valve.

4. The method of claim 1, further comprising varying the common output flow from a given piston/cylinder group and varying the direction of movement of a given hydraulic actuator associated with the given piston/cylinder group independently of one another.

5. The method of claim 1, further comprising electronically controlling the common output flow from a given piston/cylinder group and the direction of movement of a given hydraulic actuator associated with the given piston/cylinder group.

6. The method of claim 1, further comprising selectively combining the common output flow from two or more piston/cylinder groups and directing the combined common output flow to a single hydraulic actuator on the machinery.

7. The method of claim 1, further comprising providing a metering valve between first and second piston/cylinder groups so as to allow for selective hydraulic connection of the first and second piston/cylinder groups.

8. The method of claim 1, further comprising directing the common output flow from each respective piston/cylinder group to a single hydraulic actuator on the machinery, respectively.

9. The method of claim 1, further comprising selectively directing the common output flow from a given piston/cylinder group to more than one hydraulic actuator on the machinery.

10. The method of claim 1, further comprising varying restriction of flow between a given hydraulic actuator on the machinery and tank.

11. The method of claim 1, further comprising routing the common output flow from a given piston/cylinder group through a pilot operated check valve before the common output flow from the given piston/cylinder group reaches a given hydraulic actuator associated with the given piston/cylinder group.

12. The method of claim 1, further comprising limiting a maximum pressure in two or more piston/cylinder groups by providing check valves downstream of the two or more piston/cylinder groups, respectively, and by providing a single relief valve downstream of the check valves.

13. The method of claim 1, further comprising routing the common output flow from a given piston/cylinder group through at least one load check valve upstream of a given hydraulic actuator associated with the given piston/cylinder group.

14. An assembly for increasing the efficiency of heavy machinery having hydraulic actuators performing work with fluid supplied from radial hydraulic pumps, the assembly comprising:

a plurality of radial hydraulic pumps aligned end-to-end along a common driveshaft axis, including a plurality of piston/cylinder units extending in a radial direction about the driveshaft axis, wherein two or more piston/cylinder units in the plurality of piston/cylinder units are associated with one another to form multiple piston/cylinder groups;

a plurality of control valves, each control valve in the plurality of control valves receiving and combining individual output flows from each of the two or more associated piston/cylinder units into a respective common output flow for each respective piston/cylinder group; and a plurality of flow control devices, each flow control device in the plurality of flow control devices varying the common output flow from each respective piston/cylinder group by throttling inlet flow to the two or more associated piston/cylinder units in each respective piston/cylinder group;

wherein each respective common output flow is directed from each respective piston/cylinder group to a hydraulic actuator on the heavy machinery so as to control a direction of movement of the hydraulic actuator.

15. The assembly of claim 14, wherein a given control valve and a given flow control device associated with a given piston/cylinder group are one of mechanically and hydraulically coupled to one another, thereby enabling the common output flow from the given piston/cylinder group and the direction of movement of a given hydraulic actuator associated with the given piston/cylinder group to be varied simultaneously.

16. The assembly of claim 15, further comprising a single spool valve that varies the common output flow from the given piston/cylinder group and varies the direction of movement of the given hydraulic actuator simultaneously.

17. The assembly of claim 16, wherein the given piston/cylinder group extends in an axial direction, parallel to the driveshaft axis, and further comprising a control housing coupled to the plurality of radial hydraulic pumps and extending in the axial direction that holds the single spool valve.

18. The assembly of claim 17, further comprising inlet and outlet check valves associated with each piston/cylinder unit in the given piston/cylinder group that are retained by the control housing.

19. The assembly of claim 14, wherein each control valve is independent of each flow control device, thereby enabling the common output flow from a given piston/cylinder group and the direction of movement of a given hydraulic actuator associated with the given piston/cylinder group to be varied independently of one another.

20. The assembly of claim 14, further comprising:

an electro-hydraulic pilot-operated valve located upstream of at least one piston/cylinder group and controlling the common output flow from the at least one piston/cylinder group; and multiple electro-hydraulic pilot-operated valves located downstream of the at least one piston/cylinder group and controlling the direction of movement of one or more hydraulic actuators associated with the at least one piston/cylinder group.

21. The assembly of claim 14, further comprising a metering valve between a first piston/cylinder group and a second piston/cylinder group that allows for selectively combining the common output flow from the first and second piston/cylinder groups and directing the combined common output flow to first and second hydraulic actuators on the heavy machinery associated with the first and second piston/cylinder groups.

22. The assembly of claim 14, further comprising a flow restricting mechanism between a given hydraulic actuator on the heavy machinery and tank.

23. The assembly of claim 14, further comprising a pilot operated check valve through which the common output flow from a given piston/cylinder group is routed before the common output flow from the given piston/cylinder group reaches a given hydraulic actuator associated with the given piston/cylinder group.

24. The assembly of claim 14, further comprising:

check valves downstream of two or more piston/cylinder groups, respectively; and a single relief valve downstream of the check valves;

wherein together the check valves and the relief valve allow for limiting of a maximum pressure in the two or more piston/cylinder groups.

25. The assembly of claim 14, further comprising at least one load check valve downstream of a given piston/cylinder group and upstream of a given hydraulic actuator associated with the given piston/cylinder group.

26. The assembly of claim 14, wherein each piston/cylinder group extends in one of (a) an axial direction, parallel to the driveshaft axis and (b) the radial direction, around a circumference of the assembly.

27. The assembly of claim 14, wherein the plurality of radial hydraulic pumps are situated within a common pump housing.

* * * * *